US007409787B2

(12) United States Patent
Glenn

(10) Patent No.: US 7,409,787 B2
(45) Date of Patent: Aug. 12, 2008

(54) CARICATURE APPARATUS AND METHOD OF MAKING SAME

(76) Inventor: Donna Denine Glenn, P.O. Box 1177, Sandpoint, ID (US) 83864

( * ) Notice: Subject to any disclaimer, the term of this patent is extended or adjusted under 35 U.S.C. 154(b) by 350 days.

(21) Appl. No.: 11/189,554

(22) Filed: Jul. 25, 2005

(65) Prior Publication Data

US 2006/0101679 A1 May 18, 2006

Related U.S. Application Data

(63) Continuation-in-part of application No. 10/816,570, filed on Apr. 1, 2004.

(60) Provisional application No. 60/459,709, filed on Apr. 2, 2003.

(51) Int. Cl.
*G09F 1/00* (2006.01)

(52) U.S. Cl. ..... 40/124.09; 229/922; D11/125; 446/488

(58) Field of Classification Search ..... 40/124.09, 40/539; 229/68.1, 922; 428/4; D11/125; 206/449, 457, 39, 39.7; 446/488
See application file for complete search history.

(56) References Cited

U.S. PATENT DOCUMENTS

| | | | | |
|---|---|---|---|---|
| 395,953 A | | 1/1889 | Clark | |
| 727,723 A | | 5/1903 | Webb | |
| D53,469 S | | 6/1919 | Samour | |
| D60,094 S | | 12/1921 | Heindl | |
| 1,903,096 A | * | 3/1933 | Dow | 206/459.5 |
| 2,164,966 A | | 7/1939 | Tutein | 93/84 |
| 2,792,167 A | | 5/1957 | Sparks | 229/40 |
| 2,922,239 A | | 1/1960 | Glynn, Jr. | 41/11 |
| 3,041,765 A | | 7/1962 | Paar | 41/10 |
| 3,241,173 A | | 3/1966 | Finn | 15/328 |
| 3,618,157 A | | 11/1971 | Bassin | 15/330 |
| 3,985,285 A | | 10/1976 | Kitagawa | 229/8 |
| 4,182,060 A | | 1/1980 | Longenecker | 40/124.1 |
| 4,185,767 A | | 1/1980 | Sykora et al. | 229/39 R |
| 4,201,331 A | | 5/1980 | Austin | 229/39 R |
| 4,558,980 A | | 12/1985 | Sturdivan | 412/2 |

(Continued)

OTHER PUBLICATIONS

Two pages from www.bayleyboxes.com web site, Copyright Bayley's Boxes 2002 Black Hawk, CO 80422.

*Primary Examiner*—Gary C. Hoge
(74) *Attorney, Agent, or Firm*—Pedersen & Co., PLLC; Ken J. Pedersen; Barbara S. Pedersen

(57) ABSTRACT

A card-like apparatus may be used as a card, a bow, a decoration, or other item, and is preferably made from a single sheet having an interior central region in the shape of a regular polygon defined by fold lines between the central region and a plurality of extremity panels. The panels fold across and beyond the central region, forming an outer perimeter that represents a flower, plant, holiday novelty, animal, person, or other object or living thing. Decoration such as paint, print, artwork, or a portion of a picture may be added to the panels so that the folded panels further represent the object or living thing. Methods have been developed to dissect a whole picture and then to lay or copy sectors of the picture onto distal portions of the panels, so that upon folding of the panels, the distal portions are visible, over and beyond the central region, in positions wherein the picture comes together again as a whole.

22 Claims, 21 Drawing Sheets

U.S. PATENT DOCUMENTS

| | | | | | |
|---|---|---|---|---|---|
| 4,763,427 | A | | 8/1988 | Schrager | 40/124.1 |
| 5,240,750 | A | | 8/1993 | Cheng | 428/5 |
| 5,370,421 | A | | 12/1994 | Kaiser | 283/117 |
| 5,545,486 | A | * | 8/1996 | Asano et al. | 428/542.8 |
| 5,558,272 | A | | 9/1996 | Magister | 229/109 |
| 5,622,384 | A | | 4/1997 | Bradley | 281/2 |
| 5,626,551 | A | | 5/1997 | Kearns et al. | 493/231 |
| 5,645,214 | A | | 7/1997 | Taganas | 229/313 |
| 5,817,378 | A | | 10/1998 | Otani | 428/12 |
| D410,196 | S | * | 5/1999 | Berg | D9/432 |
| D410,785 | S | | 6/1999 | Leasure et al. | D34/24 |
| 6,009,595 | A | | 1/2000 | Leasure et al. | 15/329 |
| 6,053,399 | A | * | 4/2000 | Wurdeman | 229/68.1 |
| 6,074,712 | A | | 6/2000 | Ramirez | 428/4 |
| 6,106,017 | A | * | 8/2000 | Johnson | 283/2 |
| 6,112,441 | A | | 9/2000 | Offenhauer | 40/124.191 |
| 6,199,912 | B1 | | 3/2001 | Finkelshteyn | 283/117 |
| 6,221,458 | B1 | | 4/2001 | Armendariz | 428/99 |
| D441,316 | S | | 5/2001 | Burghoffer | D11/184 |
| 6,237,819 | B1 | | 5/2001 | Ramirez | 223/46 |
| D457,028 | S | * | 5/2002 | Beutler | D6/632 |
| D457,555 | S | | 5/2002 | Stephens-D'Angelo et al. | D19/1 |
| D460,481 | S | | 7/2002 | Gravino | D19/6 |
| D464,261 | S | | 10/2002 | Hereth | D9/422 |
| 6,460,277 | B1 | | 10/2002 | Tower | 40/1.5 |
| 6,513,270 | B1 | | 2/2003 | Mackenzie | 40/124.08 |

* cited by examiner

CARICATURE APPARATUS AND METHOD OF MAKING SAME

This application is a continuation-in-part of, and claims priority of U.S. patent application Ser. No. 10/816,570, filed Apr. 1, 2004, entitled "Multi-Purpose Ornamental Caricature Device and Method Therefor, which in turn claims priority of U.S. Provisional Patent Application No. 60/459,709, filed Apr. 2, 2003, the disclosures of both of which are hereby incorporated by reference.

BACKGROUND OF THE INVENTION

Field of the Invention

The present invention generally relates to cards, decorations, and other novelties that are constructed by folding a sheet of paper or other material. More specifically, the preferred embodiment relates to a folded item that has an outer perimeter forming the shape of a decorative or whimsical object, animal, character, or person, and that has a visible surface comprising art, graphics, or other indicia on multiple panels that have been folded into positions wherein they, together, represent the object, animal, character, or person.

SUMMARY OF THE INVENTION

The present invention comprises a card or sheet apparatus that is folded to take the form, both in outer perimeter and in decoration, of a decorative or whimsical animal, person, caricature of a person or animal, flower, or plant, or other object or living thing. Preferably, the apparatus comprises a single sheet that has a central region and panels extending from the central region, wherein said panels are folded over the central region, meet over the central region, and preferably extend beyond the perimeter of the central region, including extending across/beyond the folds of one or more other panels. Most preferably, a given panel extends across/beyond the folds of panels one and two positions away from the given panel. The folded panels therefore cover most or all of the central region, and their distal ends form the outermost extremity of the apparatus to become an outline of the represented object or living thing. Preferably, there is only one fold between each of said panels and the central region, and no vertical walls, so that the apparatus has a flat, substantially two-dimensional shape. Methods for making the apparatus include dissecting a whole picture, and placing sectors of the picture on generally distal portions of a plurality of the panels, wherein the sectors are places on particular ones of the panels, and at angles to the radial dimension of each panel, such that, when the apparatus is folded, the picture comes together again as a whole image.

BRIEF DESCRIPTION OF THE DRAWINGS

FIGS. 1-6 illustrate one embodiment of the invention being folded, wherein FIG. 1 illustrates a flat sheet prior to folding, with the non-decorated, front side of the sheet being visible; and FIGS. 2-6 illustrate the first through fifth panels, respectively, being folded into positions showing their decorated sides; and wherein FIG. 6 illustrates the finished, folded card representing a flower, with the decorated sides of the panels having heart-shaped flower petal indicia forming the front of the folded card. In FIG. 6, a portion of the panel/petal adjacent to the last panel is shown in small hatch-marking, indicating that the last (or typically, the last two) panel(s)/petal(s) to be folded typically will need to be "flipped under" the adjacent panel, either by lifting or bending the adjacent panel (and/or bending typically the last one or two panel(s)).

FIG. 7 illustrates the decorated side of the sheet prior to folding. FIG. 8 illustrates the sheet of FIG. 7 completely folded to represent a flower and having additional paper attached to represent leaves. FIGS. 9 and 10 are rear and front views of the embodiment of FIG. 8, without the leaves.

FIGS. 13 and 14 illustrate a Christmas tree embodiment, wherein FIG. 13 is a front view of the flat sheet prior to folding, and FIG. 14 is a front view of the folded tree, with the decorated sides of the panels being visible and with a ribbon added.

FIGS. 17-19 illustrate a Santa Claus embodiment, wherein FIG. 17 is a rear view of the flat sheet prior to folding, with the decorated sides of the panels being visible; wherein FIG. 18 is a front view of the folded Santa Claus, with the decorated sides of the panels visible and a string added for hanging as a tree ornament; and wherein FIG. 19 is a rear view of the folded Santa Claus showing to good advantage how the folded panels extend far beyond the pentagon central region.

In FIGS. 1-20, surfaces marked with hatch-marks indicate the "interior" surfaces of the panels, which, when the card is in an unfolded condition, are front surfaces of the card sheet (for example, FIGS. 1-5, 13, and 20). When the card is in the folded condition, the hatch-marked surfaces become interior surfaces and not visible in a front view of the card (for example, not visible in FIGS. 6, 8, 10, 12, 14, 16, 18) and also rear surfaces of the outer/distal regions of the panels extend beyond the perimeter of the central region of the card and are visible only in a rear view of the card (for example, visible in FIGS. 9, 11, 15, 19). In FIGS. 1-20, the dashed lines denote the preferred fold lines between the panels and the central region, therefore forming the perimeter of the central region having a polygonal shape.

FIG. 27B also illustrates that the card is still much thinner than it is wide (with width being the dimension from right to left in the figure).

FIGS. 39, 40, 40A, and 40B are schematics illustrating preferred methods of making embodiments of the invention, wherein FIG. 39 is a schematic of how a picture (which would be generally within the circle) can be dissected into five sectors. FIG. 40 is a schematic of how each of the five sectors (with or without "extra" image on one or both sides of each ⅕ sector) may be placed on five panels around a pentagonal central region, wherein the ⅕ sectors are preferably placed on panel portions 30, and the optional, overlapping "extra" images extend to panel portions 26 and/or 36. FIG. 40A shows the card of FIG. 40 folded. FIG. 40B shows the card of FIG. 40, with optional panel portions 26 removed, folded, which illustrates the effect of the overlap caused by portions 26.

FIGS. 41, 42, and 42A are schematics illustrating preferred methods of making embodiments of the invention, wherein FIG. 41 is a schematic of how a picture (which would be generally within the circle) can be dissected into four sectors. FIG. 42 is a schematic of how each of the four sectors (with or without "extra" image on one or both sides of each ¼ sector) may be placed on four panels around a square central region, wherein the ¼ sectors are preferably placed on panel portions 130, and the optional, overlapping "extra" images extend to panel portions 126 and/or 136. FIG. 42A shows the card of FIG. 42 folded.

FIGS. 43, 44, and 44A and schematics illustrating preferred methods of making embodiments of the invention, wherein FIG. 43 is a schematic of how a picture (which would be generally within the circle) can be dissected into three sectors. FIG. 44 illustrates how the three sectors (with or without "extra" image on one or both sides of each ⅓ sector) may be placed on four panels around a triangular central region, wherein the ⅓ sectors are preferably placed on panel portions 230, and the optional, overlapping "extra" images extend to panel portions 226 and 236. FIG. 44A shows the card of FIG. 44 folded.

FIGS. 45, 46, and 47 A-F illustrate a snowman embodiment. FIG. 45 represents a unified, whole picture such as may be found in a clipart portfolio or other source. FIG. 46 illustrates how the sectors that are cut/copied from the whole picture are laid on the card sheet.

DESCRIPTION OF THE PREFERRED EMBODIMENTS

Figure 1:
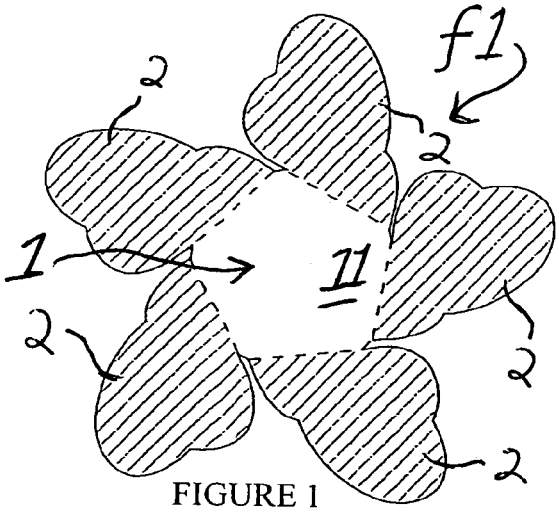
Figure 2:
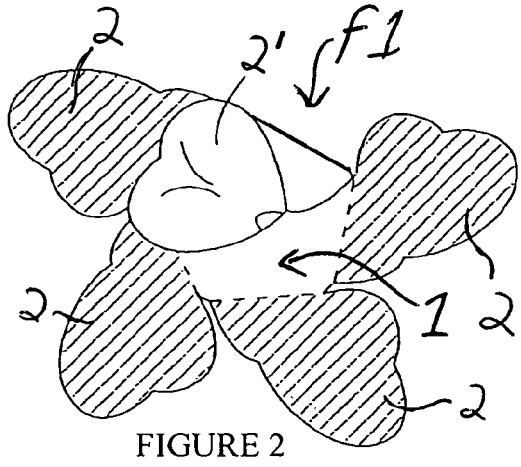
Figure 3:
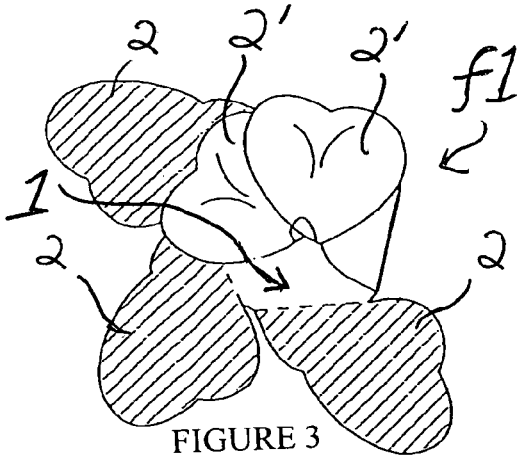
Figure 4:
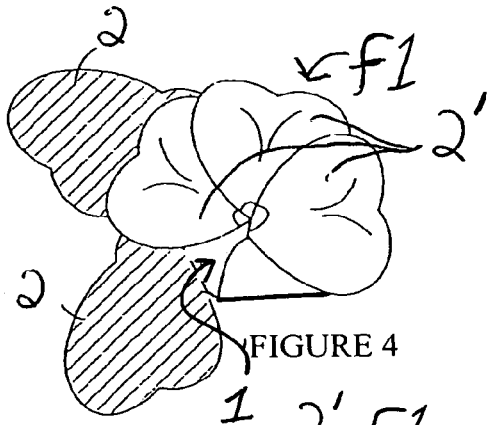

Referring to the Figures, there are shown several, but not the only, embodiments of the invented apparatus and methods. Embodiments of the invented apparatus may be used as cards, bows, ornaments, invitations, party favors, toys, craft items for decorating scrapbooks or other objects, items hung on a mobile, brochures, promotional items, novelties, etc., but the term "cards" and/or "novelty" is/are used herein for simplicity and not necessarily to limit the use of the apparatus or methods.

The preferred embodiments are formed by folding a preferably flat sheet of paper or other sheet material "into itself," wherein panels that extend from a geometrically-shaped central region are folded inward across a portion of the central region to extend beyond the perimeter of the central region. The panels substantially cover, and preferably entirely cover, the central region and also extend a substantial distance beyond the central region, forming either a symmetrical or an unsymmetrical outer perimeter typically quite unlike the perimeter of the central region. The resulting outer perimeter of the folded card represents/mimics the shape of a decorative or whimsical object, animal, character, or person. The folded panels preferably comprise art, graphics, or other indicia on their visible surfaces so that they, together, form a front surface of the folded card that also represents/mimics the object, animal, character, or person. While art, graphics, or other indicia (hereafter, simply called "decoration") is not required, it is preferred, because it creates an item that is eye-catching and attractive and that represents not only the general outline (the outer perimeter), but also the color, shading, and likeness, of the object, animal, character, or person. Further, the decoration enhances the surprise and novelty of the transformation from a preferably flat sheet (with "scattered" or apparently random decorations) to an item representing an object, animal, character, or person, which transformation occurs with only a few folds.

From the Figures, one may see that the preferred embodiments include decoration that is "broken up" or "scattered" for placement on a plurality of panels (also called "extremity panels"), but that, when the panels are folded, the decoration comes together over the central region and extends beyond the central region, to form a unified picture, theme, or likeness. The central region is preferably a symmetrical geometric shape, such as a triangle, square, rectangle, pentagon, hexagon, octagon, etc., with each side of the geometric shape preferably being straight, so that a straight fold may be made along preferably each, or at least along a plurality of, straight side(s). From each straight side of the central region may extend a panel, foldable relative to the central region at the straight side preferably aided by scoring, perforation, prior creasing or other thinning or hinging along the straight side. The panels may be the same size and shape, or may be different/various sizes and shapes. The sides of the central region, and therefore the panel foldlines, may or may not be equal in length. The panels preferably extend integrally from the central region, that is, they may be of the same material and sheet as the central region, or they may be attached to the central region or to tabs extending from the central region, for example, by adhesive, fasteners, or other attachment mechanisms.

Upon being folded generally inward, the panels take positions wherein, together, they form a picture or likeness of the object, plant, flower, animal, person, or caricature, etc. The folded panels preferably overlap each other, and may overlap to varying degrees. The shape of each panel may vary in size, shape, and even material. While the panels and central region are preferably flat, preferably cut and folded from a flat sheet, and, upon folding, preferably form a flat card, some embodiments may not be flat. At least one, preferably a majority, or all, of the panels around the central region are folded.

Upon being folded, or after folding, the panels may optionally be attached to each other, or preferably hindered to some extent from "falling open." Adhesive may be used, or notches in the panels at their point of contact may keep the panels together in the folded condition. Preferably, therefore, it takes some effort by a user to lift each panel up and away from the interior central region for the user/viewer to see the inside of the card. Alternatively, the panels may be free to "fall open" when held in a position wherein gravity will unfold some or all of the panels. The inside of the card may contain indicia such as writing, a photograph, or other art, graphics, or color, as desired. The forming of the sheet, cutting of the outer perimeter shape of the sheet to be folded, outer and inner decoration/indica, and crease or fold lines, may be done by hand, computer, mechanical, or any combination thereof.

Referring Specifically to the Figures:

FIGS. 1-24 illustrates various embodiments, including flowers F1 and F2, star S1, Christmas novelties H1, H2, H3, caricature C1, and animals A1, A2.

Figure 5:
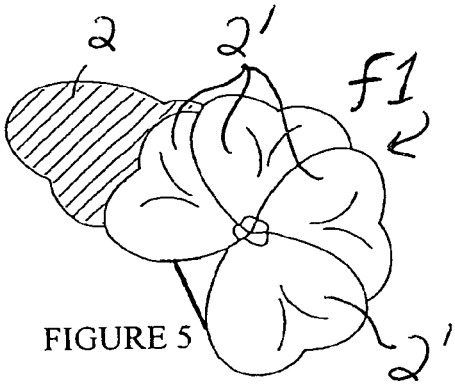
Figure 6:
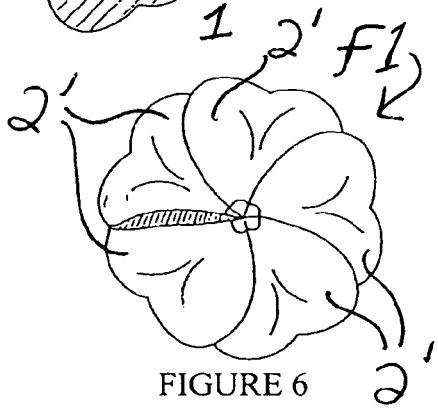

FIGS. 1-6 illustrate typical, but not the only, folding steps, wherein the hatch-marks denote the "undecorated" side of the panels (as discussed in the Brief Description of the Drawings), to help clarify that, when the panels are folded toward the viewer of FIGS. 1-6, their rear, decorated sides become visible and form the new front surface of the completed, folded flower card. In FIG. 1, a flat sheet has been cut to have a pentagon central region 1, surrounded by five flower-petal extremity panels 2, which happen to be substantially the same or identical. FIGS. 2-6 show the sequential folding of one panel-at-a-time generally toward the center of the central region 1, wherein a folded panel/petal is called-out at 2'. In this embodiment wherein the panels overlap, each panel is folded over the previous one, until the last one (or two) to be folded is inserted or "flipped" under the first-folded panel and over the just-previously folded panel, as illustrated in FIGS. 5 and 6. One may understand from FIGS. 1-6, that the central region 1, completely visible in FIG. 1, is completely covered by the folded panels in FIG. 6, and, to again see the inside of the flower card (for example, to read a message on the inside), one must open the "flower" to view the front surface 11 of the central region 1.

Figure 7:
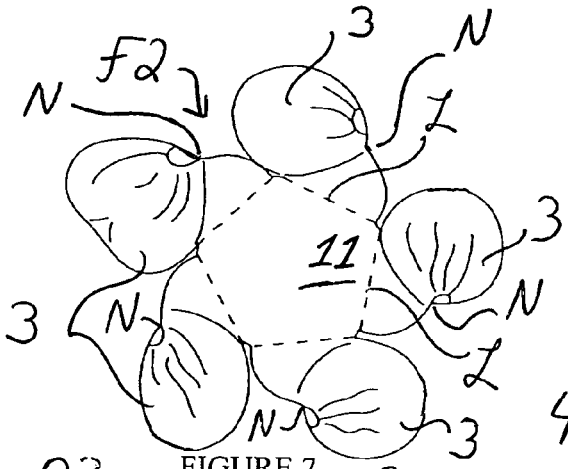
FIGS. 7-10 illustrate another flower embodiment, with rounded petals, in various views.

FIG. 7 illustrates another flower F2 sheet prior to folding, wherein one may see to best advantage, the flower petal decoration on the five panels 3 extending from the central region 1. One may note that the petal decoration does not start at the fold lines L, but rather a distance from the fold lines L, and that each petal decoration does not radiate out exactly radially from the center of the central region, but, rather, is pivoted (counterclockwise in FIG. 7).

Figure 8:
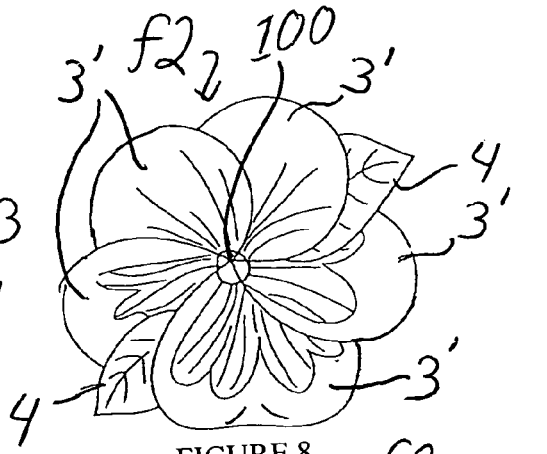
Figure 9:
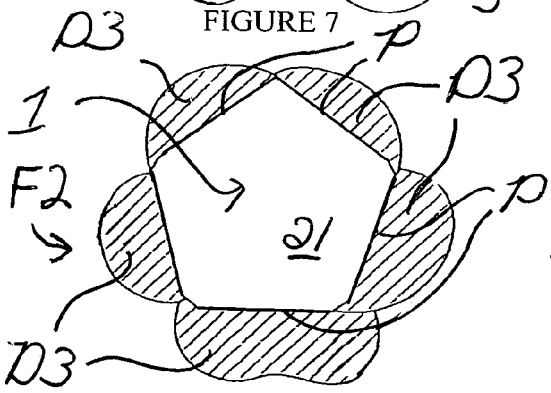
Figure 10:
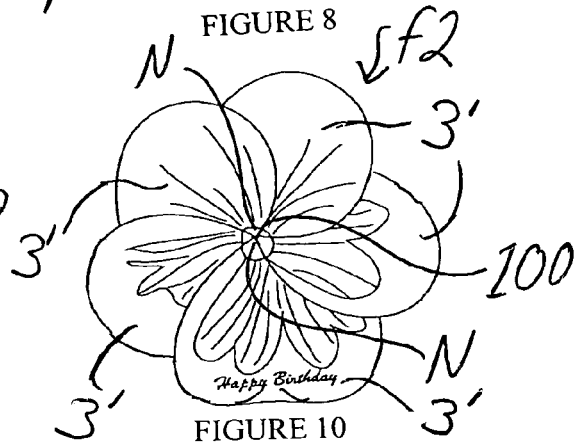

FIGS. 8-10 illustrate the sheet of FIG. 7 folded to represent the flower, with and without additional, attached rather than integral, decoration in the form of leaf-like structures. The leaves 4 are not part of the folded panels 3', but are added by sliding them in between the folded panels after folding of the card, to enhance the look of the flower.

As may be seen to best advantage in the front view of the card in FIGS. 8 and 10, the folded panels 3' completely cover the central region 1 of this card, so that the central region is not visible (in front view) and the card has only the appearance of a flower. As may be seen to best advantage in rear view of FIG. 9, the distal ends D3 of the folded panels extend beyond the perimeter P of the central region 1. In this rear view, a distal portion D3 of the undecorated surface of the panels (which was the front surface prior to folding, noted by cross-hatching) is visible and extends out from the central region 1 a distance equal to about ⅓ of the diameter of (average dimension across) the central region. One of average skill reading this Description and viewing the Figures will know how to calculate the average dimension across the central region, for example, for a pentagon, it will be close to the diameter of a circle superimposed on the pentagon of generally the same size. One will note that, in FIG. 7, the front/interior surface 11 of the central region 1 is visible, while in FIG. 9, the rear/exterior surface 21 of the central region 1 is visible. Because the central region 1 integrally connects to the panels 3, and is bounded by fold lines (not yet folded) in FIG. 7, dashed lines are used in FIG. 7 for the boundary of the central region front surface 11. Because the card has been folded in FIG. 9, and the central region in rear view is bounded by a pentagon-shaped perimeter of folded paper, solids lines are used to show the perimeter of the central region rear surface 21.

Figure 11:
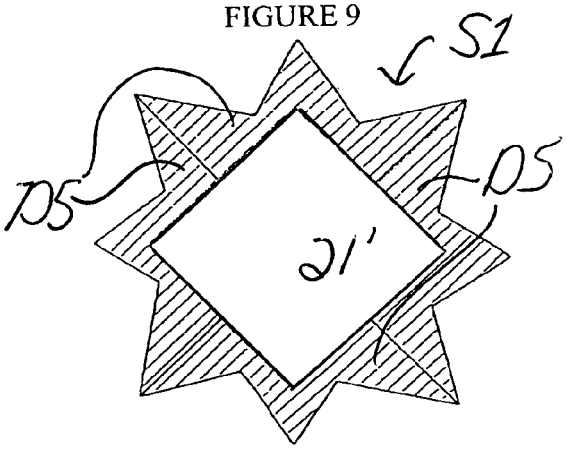
FIGS. 11 and 12 are rear and front views, respectively, of a star embodiment.
Figure 12:
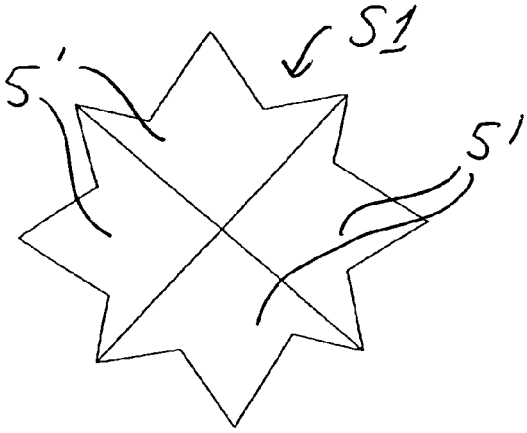

FIGS. 11 and 12 also illustrate how the folded panels 5' cover the square central region (not visible in front view, FIG. 12) and the distal ends D5 of the folded panels extend far beyond the square outer perimeter of the central region rear surface 21' (rear view, FIG. 11). Some parts of the panels of FIG. 11 extend beyond the outer perimeter of the square central region a distance of more than ½ of the central region length or width.

Figure 13:
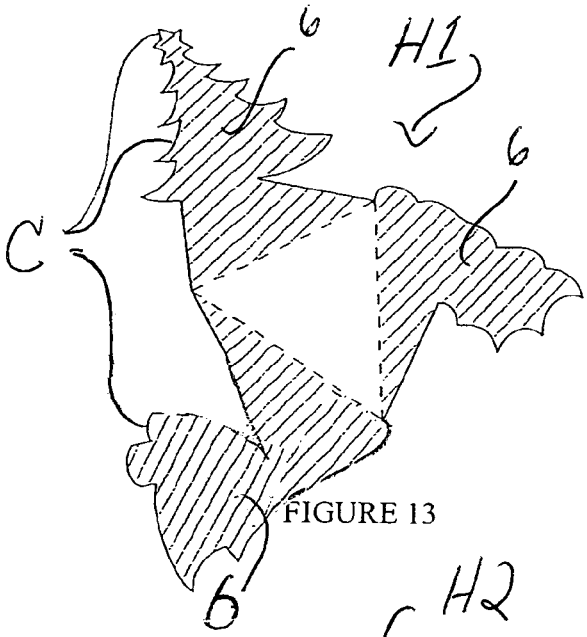
Figure 14:
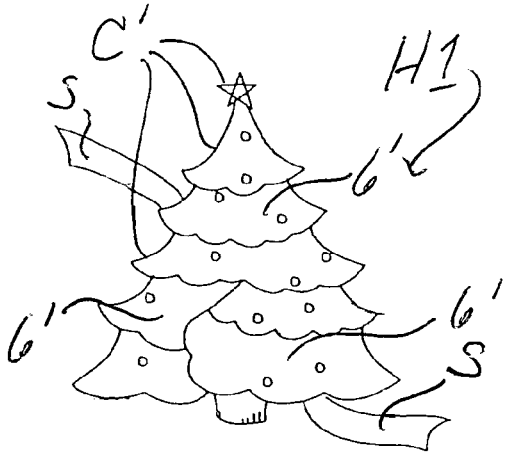

FIGS. 13 and 14 illustrate a Christmas tree embodiment H1, with a triangular central region, and panels 6 (when folded, 6') that are asymmetrical and each different from the other. Again, as in the embodiments of FIGS. 1-12, the outer perimeter C, C' of the card, before and after folding, is very different from the shape of the perimeter of the central region, and the central region is more of a base, from which the decorative panels may extend, than a visually-significant part of the card.

Figure 15:
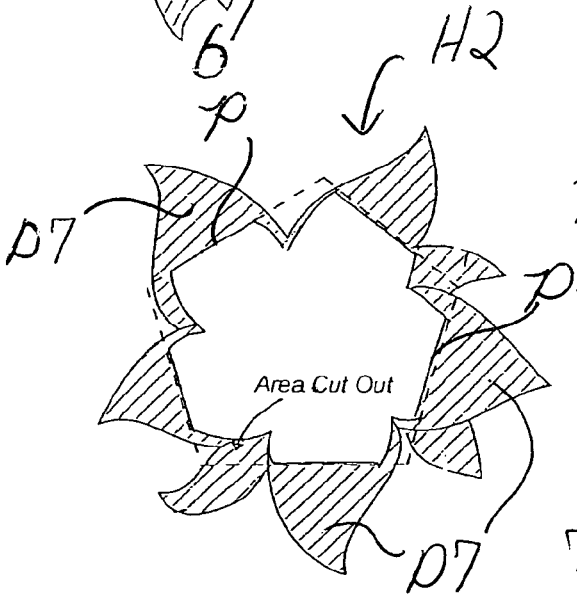
FIGS. 15 and 16 are rear and front view, respectively, of a poinsettia embodiment.
Figure 16:
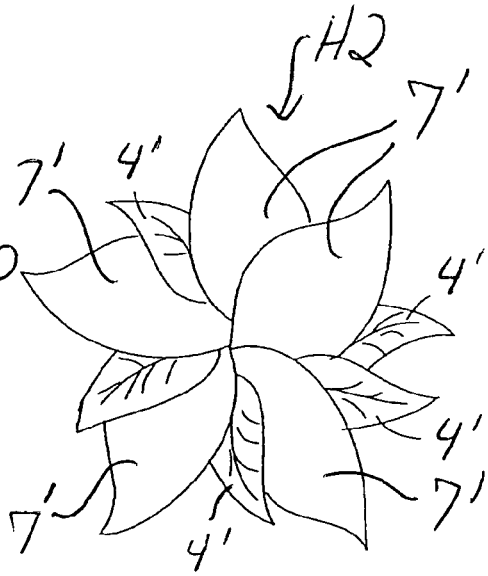

FIGS. 15 and 16 illustrate a poinsettia embodiment H2. As may be noted, especially in the rear view of FIG. 15, the distal ends D7 of the panels 7 (when folded, 7') extend a significant distance from the perimeter P of the central region. In other words, the tips of the poinsettia extend out a distance from the perimeter of the central region (in rear view) equal to about ½ of the diameter of (average dimension across) the central region. This embodiment, as drawn in FIG. 15, contrasts the perimeter P drawn in solid line with the pentagon drawn in dashed line, to illustrate that a portion of the central region may be trimmed/cut out, if needed to allow the preferred panels to form the desired object, person, animal, etc. without having any of the central region show in a front view.

The panel sizes may preferably range from just large enough to completely cover (when folded) the central region, up to many times greater than the central region, that is, extending beyond the outer perimeter of the central region (when folded) a distance several times larger than the average dimension across the central region. Thus, it may be said that the panel sizes may range from 0% to 1000% greater than of the central region, or, in other words, the same size as the central region or up to 10 times larger than the central region. In general, for larger sized cards, the panel size % will be in the smaller end of the range, as one would not typically want an already-large card to have huge panels extending away from the large central region. For smaller sized cards, the panel size % may be in the higher end of the range; for example, one could have a pentagon approximately 2 inches across forming a central region and panels about 8-inches long folding across the central region to form a card about 12-16 inches across.

FIGS. 14, 15, 16, and 18 include a ribbon S, attached leaves 4', and string S', which illustrate some of the many additional decorations and objects that may be attached to the basic, folded card, for example, to enhance the appearance of the decoration on the panels or to add different decoration. For example, glitter may be used to outline decoration on the panels, thus, being additional decoration that accentuates existing decoration. Or, additional paper or other sheet material may be added between, under, or over the panels, wherein said additional paper/material may have its own representative shape and may have its own color or pattern; examples of this different additional decoration are the leaves on FIG. 8. Additional decoration may include ribbons, strings, ties, stickers, glitter, beads, sequins, lace, photos, for example. Also, while the panels are preferably solid, optionally, portions of one or more panels may be cut out for a window-pane or lattice effect. Also, additional layers of paper or other sheet material, or protective covering, may be added. Paper, cardboard, thin polymer ("plastic"), ribbon, or even some cloth may be used for the basic card and/or for the additional decorations; paper is preferred, however, for the basic card due to its foldability.

Figure 17:
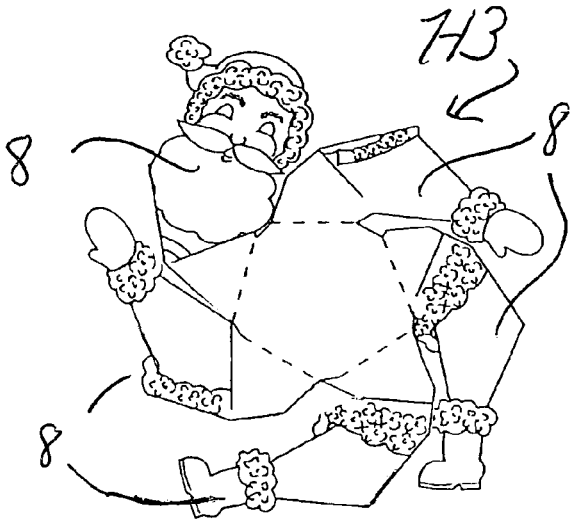
Figure 18:
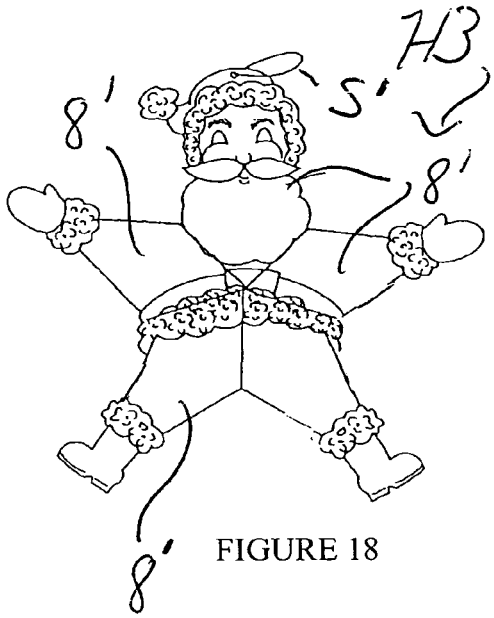
Figure 19:
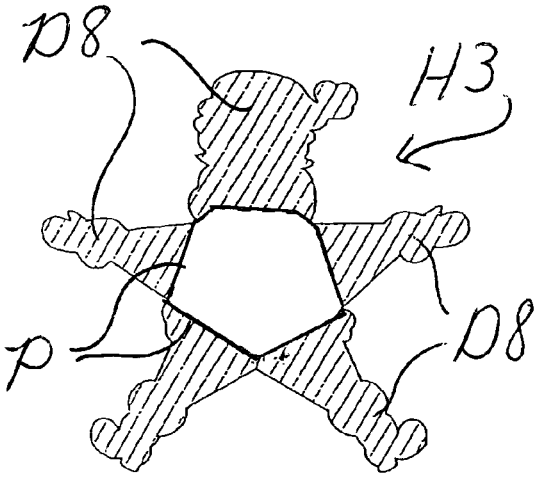

FIGS. 17-19 illustrate Santa embodiment H3, which is another embodiment that has asymmetrical panels 8 (when folded, 8'), that is, a panel with head decoration, two panels with arm and hand decoration, and two panels with leg and boot decoration. FIG. 18 illustrates the folded card with a tie/string S', for use as a tree ornament. FIG. 19 illustrates the back of the card, wherein it is clear that the distal ends D8 of the head, arm, and leg panels each extend beyond the perimeter P of the central region a distance approximately equal to the diameter of (average distance across) the central region.

Figure 20:
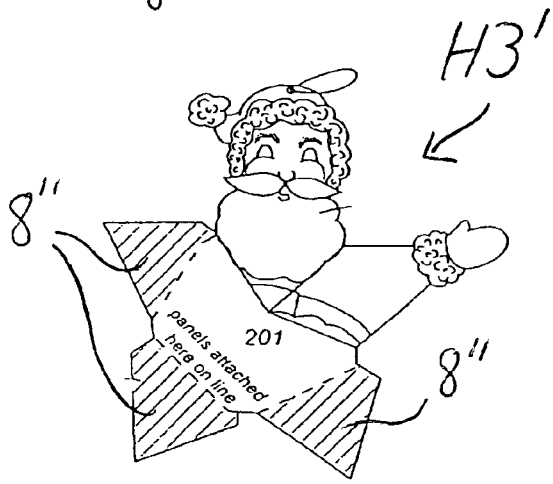
FIG. 20 is a partial, cut-away view of another Santa Claus embodiment, wherein decorated panels may be attached to generally triangular tabs, around the pentagon central region, by adhesive or other means, rather than being integral extensions of the flat sheet.

FIG. 20 illustrates a Santa embodiment H3' that is very similar to the Santa embodiment H3 in FIGS. 17-19, except that the panels of the finished card are made from multiple pieces of sheet material. The preferred decorated portions of the panels in FIG. 20 are attached by glue or other means to tabs that extend out from the central region. In the cut-away view in FIG. 20, the head and one arm panel already have been attached to two tabs and folded into place, while the cut-away reveals the three remaining generally triangular tabs 8" for receiving (by glue or other means) the decorated portions of the other arm and the two legs. Thus, FIG. 20 shows the Santa with only two of the five panels constructed and folded. After attachment of the decorated portions to the tabs, the panels will be folded to form a Santa that will look (in front view) substantially, or identically, the same as the Santa embodiment H3.

Figure 21:
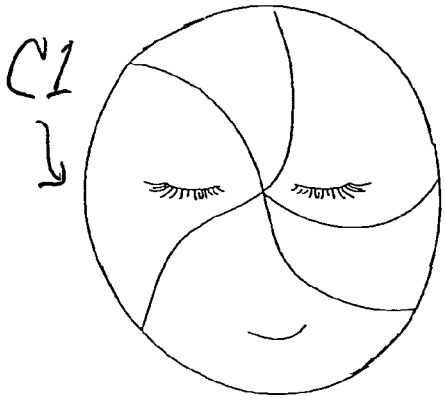
FIG. 21 is a front view of one embodiment of a folded face caricature.
Figure 22:
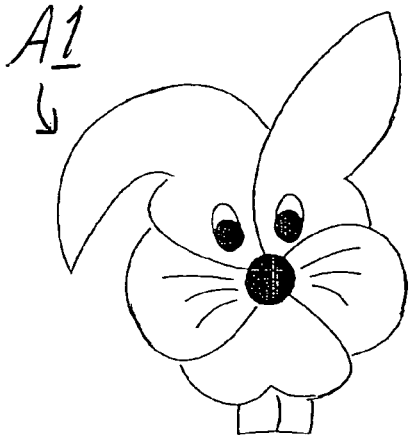
FIG. 22 is a front view of one embodiment of a folded rabbit caricature.

FIGS. 21 and 22 illustrate folded cards that are a simple caricature of a human face C1 and a rabbit caricature A1. The rabbit A1 in FIG. 22 has very asymmetrical panels, in that the ears are substantially different and longer than the cheek and mouth panels.

Figure 23:
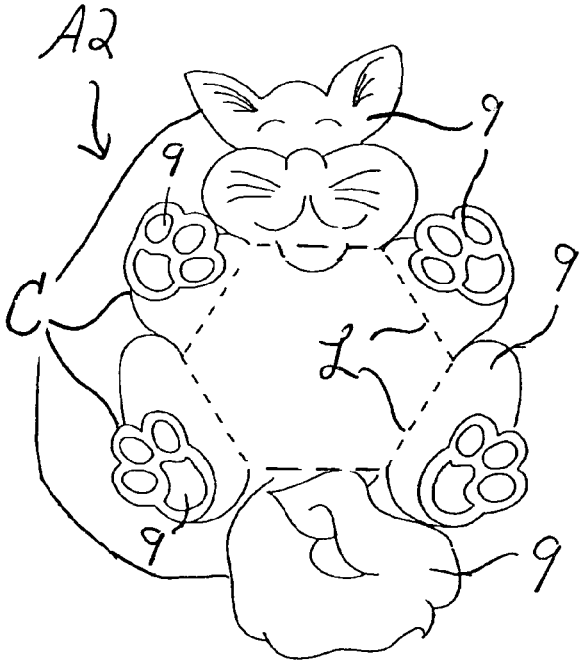
FIGS. 23 and 24 are front views of one embodiment of a cat caricature wherein decoration is on both sides of the sheet, wherein the cat caricature in FIG. 23 is unfolded; and wherein the cat caricature in FIG. 24 is folded (but only the four leg panels are folded and two of the panels (the head and tail) are not folded).
Figure 24:
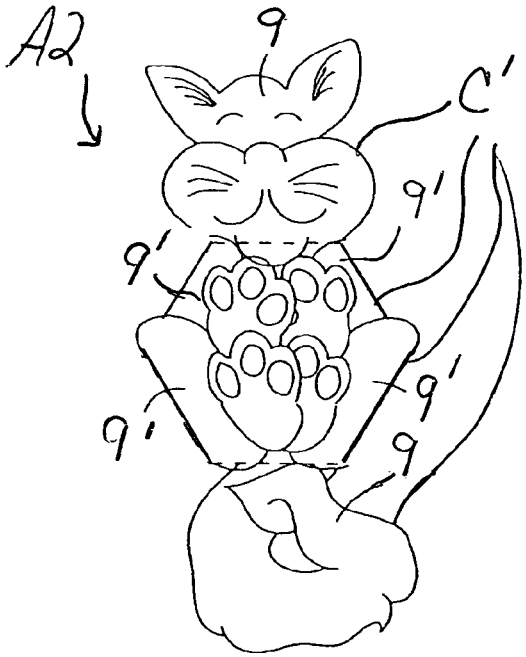

FIGS. 23 and 24 illustrate a cat caricature A2 based on a hexagonal central region, wherein decoration is placed on both sides of at least some of the panels 9 (when folded, 9'), that is, at least on the leg/paw panels. This allows the unfolded card (FIG. 23) to form a complete image, and also the folded card (FIG. 24) to form a complete image. In this case, the unfolded card outer perimeter C and front surface both represent the caricature, and also the folded care outer perimeter C' and front surface both represent the caricature. The difference between the unfolded and folded cards, therefore, is that the "cat" has "moved" between two positions. This card is one example of cards according to some embodiments of the invention wherein not all the panels fold; the cat head and tail panels preferably do not fold.

FIGS. 23 and 24 are also good examples of how the fold lines L bounding the central region need not, and preferably do not, have printed or otherwise marked lines, either solid, dashed, etc. While lines might help the person folding the card for the first time, such lines, especially if they were marked all around the hexagonal central region, would be visible in the unfolded cat card of FIG. 23 and also in the folded cat card of FIG. 24. Accordingly, dashed lines are used in the drawings of this application, for example, to illustrate the hexagonal central region of FIGS. 23 and 24, but it will be understood that the sheet of material need not be folded along all the dashed lines and that the dashed lines bounding the central region are preferably not actually marked with indicia on the sheet of card paper. Even in embodiments wherein all panels (all the way around the central region) are folded, fold lines are preferably not marked with ink or other dark indicia, because they will show when the card is unfolded. When a card is used to convey a message inside the card, or show a photo, etc., such lines would be distracting or unattractive.

Optionally, and preferably in some embodiments, writing, text, messages, or drawings may be included on the inside of the card, or even on the outside of the card. Thus, drawings other than the basic decoration (which represents the animal, object, person, etc.) may be added, for example, a sketch of a family member superimposed over a petal of one of the flower cards.

Various means of attaching the card to other objects may be used. Adhesive, double-sided tape or stickers, stapled stickers, sticky pad, magnet, elastic, ribbon, string, or other fasteners may attach the card to a package, a gift, a household item, a locker, a memento, a scrapbook page, etc. While it is preferred that the basic shape of the sheet to be folded is cut during manufacture, it may be formed/cut at a later date, for example, with a cutting guide or scrap-booking template. While it is preferred that the basic color(s) and decoration on the preferred panels be pre-printed during manufacture, it may instead be placed on the panels at a later date, for example, by stamps, by hand-drawing or painting, or other means. One set of preferred embodiments are made with colored paper(s), but with no art, indicia, or graphic design on the panels, so that a craft or scrap-book hobbyist may add their own design art, graphic design, stamps, photos, etc., to customize the apparatus.

It is desired that the basic folded card, with its central region and plurality of attached/connected/integral panels, be adapted to fold to represent the animal, object, person, or caricature, without requiring additional, "add-on" decoration, paper, or objects. However, in some embodiments, add-on decoration may be especially desirable, for example, a cotton puff added to accentuate a lamb's tail, or a three-dimensional red ball to accentuate a clown's nose.

Figure 25:
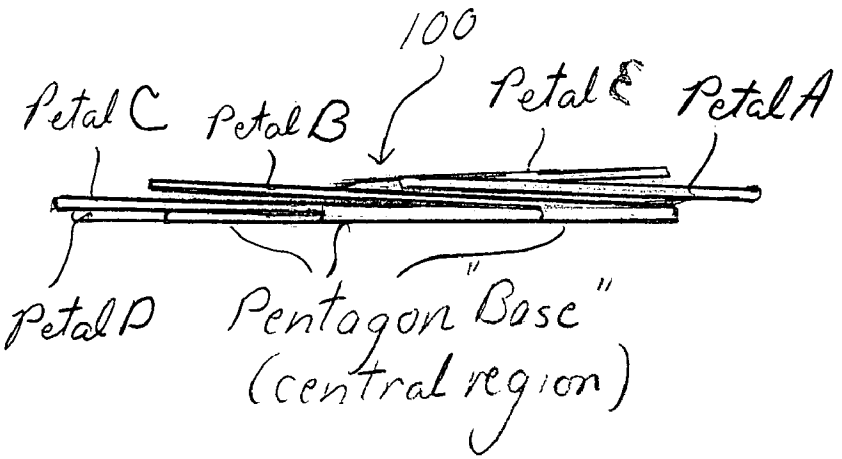
FIG. 25 is a schematic edge view of the flower embodiment of FIGS. 9 and 10 (folded from the sheet of FIG. 7), wherein the thicknesses of the various portions of the folded sheet have been exaggerated for ease of illustration.

The folded cards are preferably flat and thin, with the panels substantially parallel to the central region, and with portions of the panels contacting the central region. Many of the areas of the flat and thin folded card are three layers thick, that is, a layer that is the central region, a layer that is a given panel near its foldline, and a layer that is an adjacent panel where it overlaps the given panel. If the overlap is greater, for example, so that the adjacent panel overlaps the given panel and also the next panel over (on the side opposite the "given panel" from the "adjacent panel"), the folded card may have regions that are four layers thick. Still, because the layers are preferably thin and parallel, the total thickness of the card is still thin, for example, about 5 mm thick or less for most foldable papers. This may be illustrated by a schematic edge view of the flower card F2 in FIGS. 9 and 10. This schematic edge view in FIG. 25 exaggerates the thickness of the layers of the central region ("base") and the panels (A, B, C, D, and E) for convenience of illustration, but shows that the preferred card may be considered a flat and thin card, that is, a substantially two-dimensional card.

Figure 27A:
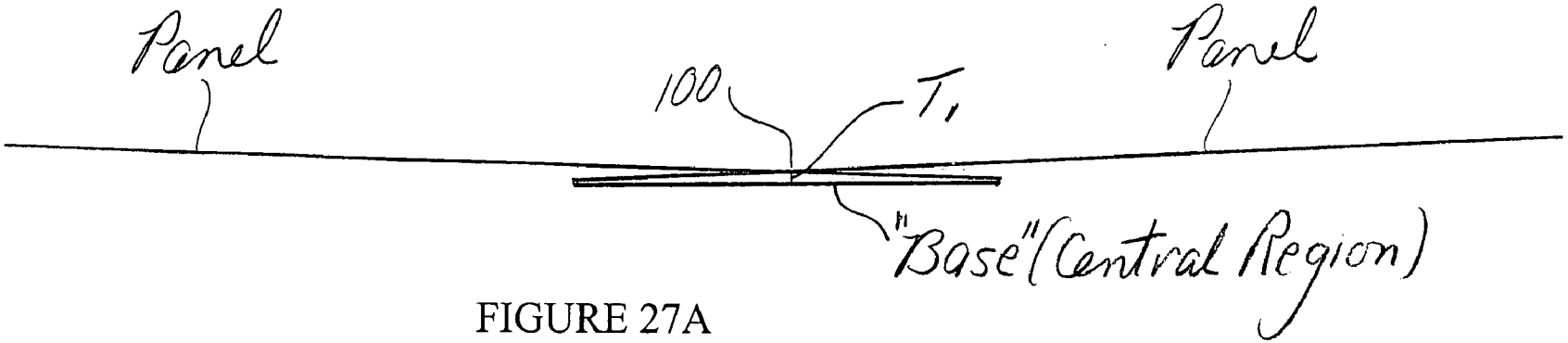
FIG. 27A is a schematic edge view, illustrating that in the preferred flat and thin card, the panels are generally parallel to, and against, the central region, so that the thickness (T1) at the center of the card is very small.

This two-dimensional feature is further illustrated in FIG. 27A, which schematically illustrates panels lying very close to and generally parallel to the central region, which a very small thickness (T1) from the inner surface (11) of the central region to the bottom (inside surface) of the folded panels at the point of contact 100.

In order to produce the preferred flat card, the panels are shaped so that, when folded at its border with the central region, each panel will overlay the central region and one or more adjacent panels, and each panel should have an open space or notch at the point of contact 100 with the other panels that is large enough to allow all the panels to lie flat against the underlying panels/central region. As illustrated by the flower embodiment in FIGS. 7-10, and 25, the notch area N allows the panels to "meet in the middle" and lie flat, without interfering with each other. If the notch area N is too deep, the panels will lie flat and there will be a visible gap between the panels at the "point of contact" (or, more accurately, because the panels would no longer contact at that point, near the center of the design between the panels). If, on the other hand, as illustrated by the modified flower sheet in FIG. 26 (which is substantially the same as that in FIG. 7, except that the notches N are less deep), the panels will still meet but will not be flat against the central region and each other when they do. Instead, when the panels meet, as schematically shown in FIG. 27B, they will be slightly raised off of the central region and slightly distanced from each other, forming a slightly three-dimensional shape. In other words, if the panel is enlarged in the point of contact area 100, rather than having the appropriately-sized space or notch, the panels will abut each other when the panels are still slightly raised, and they will not lie completely flat. Still, even this slightly-three dimensional shape is more flat than thick, as may be seen from FIG. 27B. Thus, the preferred embodiments, both the substantially flat cards and the slightly three dimensional cards, are generally flat. There is preferably no space or up to at most 5 mm between the panels and the central portion in the flat cards (the distance from the point of contact of the panels to the central region, measured perpendicularly to the central region surface, see T1, FIG. 27A). There is preferably less than or equal to 2 cm of space between the panels and the central portion in the slightly-three dimensional cards (again, the distance from the point of contact of the panels to the central region, measured perpendicularly to the central region surface, see T2, FIG. 27B). Flat cards are especially desirable, for example, for cards that are mailed in an envelope, bows for placement on packages that are wrapped and shipped (wherein a conventional bow would be crushed), or for scrapbook pages. Slightly-three-dimensional cards are desirable for mobiles, table decorations, party favors, for example.

While the point of contact may theoretically be defined as a single point in many embodiments, the practicalities of designing and forming such cards will normally result in the panels meeting generally near a single point, but not necessarily exactly all at a single point. Therefore, the term "point of contact" or "contact point" should be understood to not necessarily mean perfectly accurate contact at only a single point. Therefore, the inventor also may use the term "contact area" to remind the reader that it need not be a perfect, single point.

As illustrated to best advantage in FIGS. 2-5, 7, 13, 17, 26, 30, 32, 34 portions of the panels that are visible when the card is folded (hereafter, "visible decorated portions of the panels" or "visible portions") and that form the representation of the animal, plant, person, caricature, etc., are distanced from the central region by "arm" or "connecting portions" of the panel. The connecting portions need not be decorated, because they are covered by the visible portions (of adjacent panels) upon folding of the card and typically do not play a role in the overall theme or design of the folded card other than working to properly position the decorated portions. However as discussed later in this Description, some connecting portions are also decorated.

To create the overall theme or representation for the folded card, a whole picture is cut into fractions corresponding to the number of panels. For example, into fifths for FIGS. 2-5, 7, 17, 26, 30 and 32, thirds for FIG. 13, and fourths for FIG. 34. The fractions of the picture are then placed on the visible portions of the panels, in a position on the panels pivoted away from exactly-radial positions. In other words, the picture fractions are laid down/copied onto the panels in such a way that their radii or "radial lengths RL" (which would be the radial dimension of the picture fraction in its normal position in the whole picture) are at an angle (AP) relative to the "radial dimension R" of the panels. For example, in FIGS. 7 and 26, the flower petals are pivoted about 70-110 degrees (AP) relative to the "radial dimension R" straight out from the center of the pentagon (see lines R on FIG. 26). In FIG. 13, the Santa head, arms, and legs are pivoted about 120-150 degrees relative to a radial direction straight out from the center of the pentagon. This placement of the visible portions of the panels, at an angle to the radial dimension R of the panels, is important to the visible portions being properly placed to form the whole picture or image on the folded card, as will be further discussed later in this Description. The preferred angle AP changes with the card geometry, the central region and how many panels are used, but the preferred angle AP may be said to be between 30 and 150 degrees, more typically between 30 and 110, and more typically between 30 and 90 degrees. In view of there preferably being angles between the radial lengths RL (of the distal ends or visible portions of the panels) and the radial dimensions R of the panels, it may be said that the panels, in general, bend or curve, so that they can extend beyond the central region by crossing beyond the plane of one adjacent foldline, or preferably beyond the plane of the immediately-adjacent foldline plane and the plane of the foldline two panels away (wherein these foldline planes are planes generally perpendicular to the central region plane).

Figure 28:
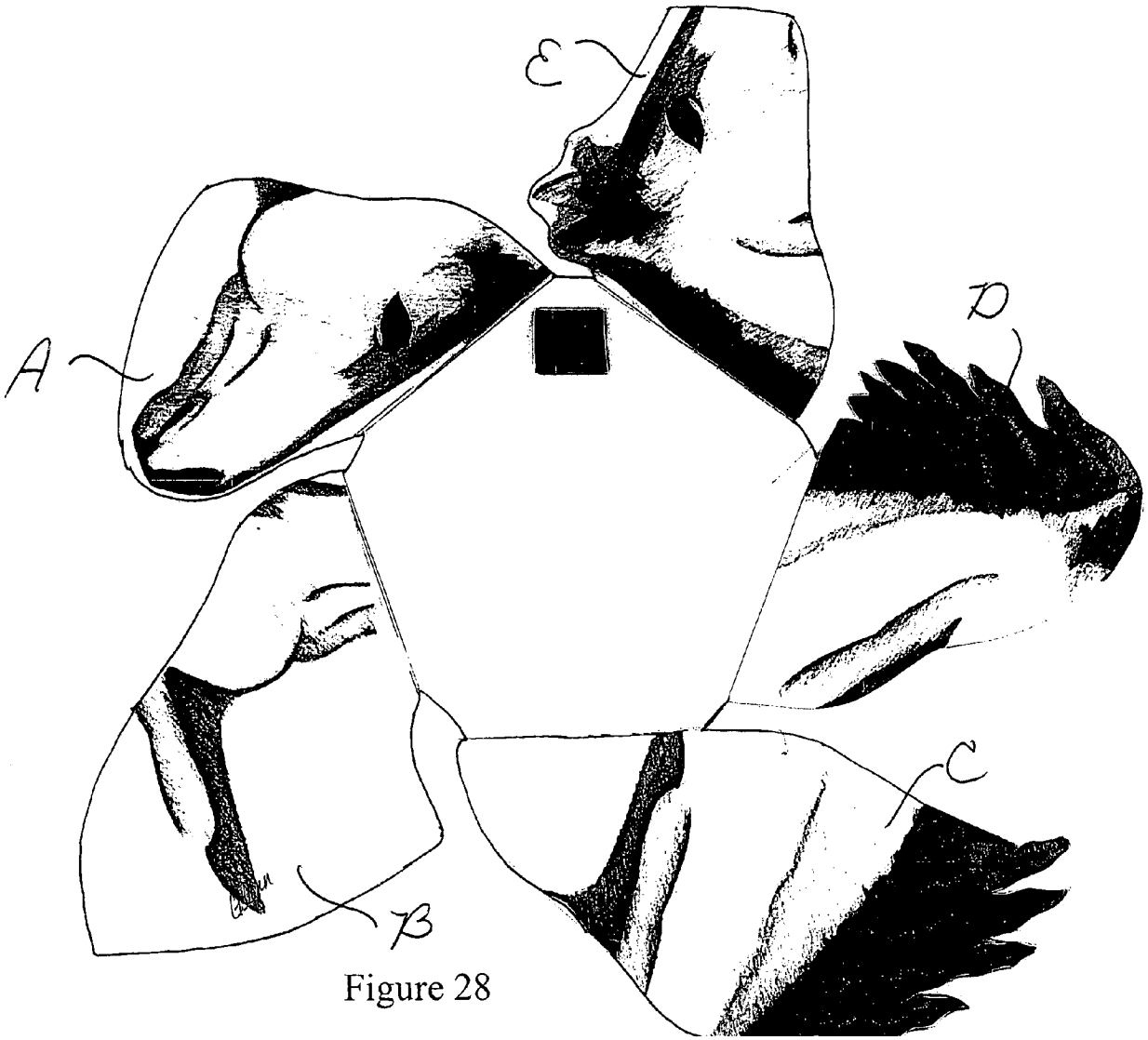
FIGS. 28 and 29 are an unfolded rear view, and a folded front view, respectively, of an embodiment forming a horse image.
Figure 29:
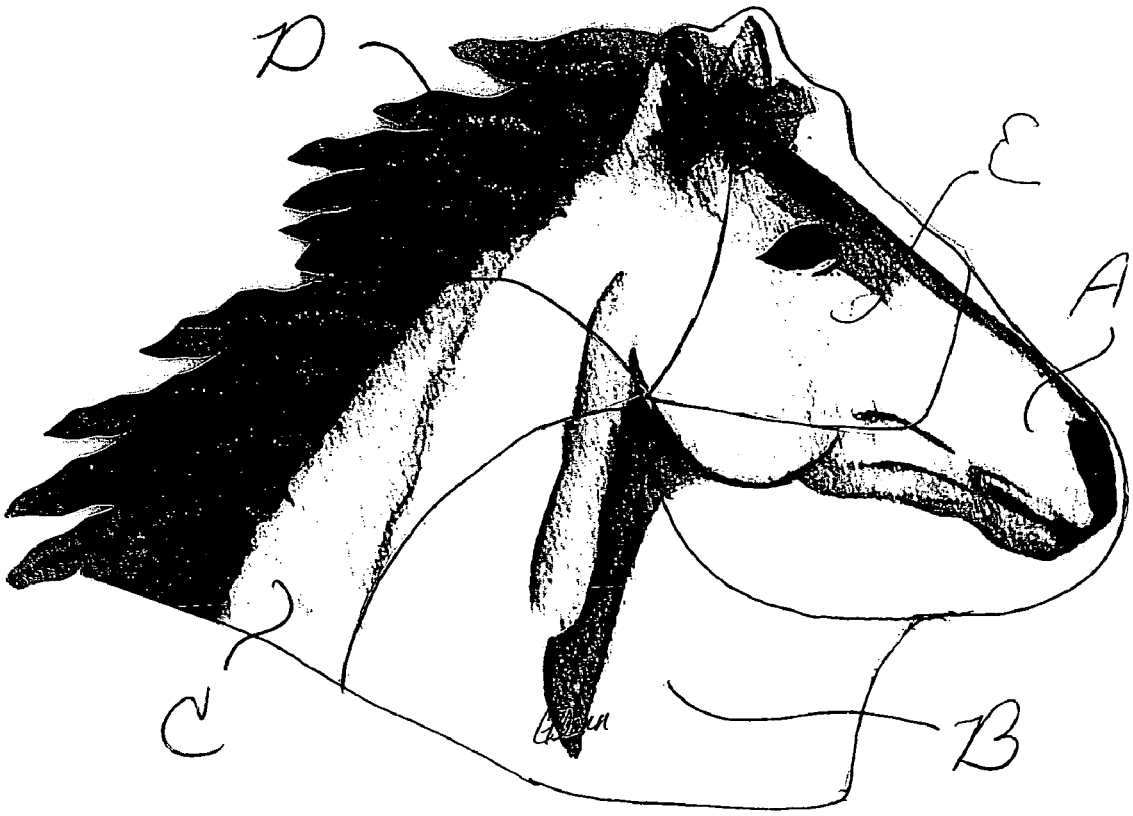

FIGS. 28 and 29 illustrate a horse embodiment that extends the decoration all the way or substantially all the way to the foldline/perimeter of the central region, so that both the visible portions and the connecting portions have decoration. However, the visible portions are still at an angle to the radial dimensions R of the panels. That is, when folded, the decoration on the connecting portions is not visible, but rather covered up by the visible portions of the panels (which are distally farther out on the panels). Thus, of the decoration on panel A shown in FIG. 28, only the horse's nose is visible when the card is folded (see FIG. 29), with the horses eyes of that panel hidden. The horse's eyes that are visible when the card is folded are contributed from panel E, while the horse's main from panel E is hidden, etc. In the horse embodiment of FIGS. 28 and 29, the visible portions are approximately 90 degrees from the radial dimensions R of the panels.

Figure 30:
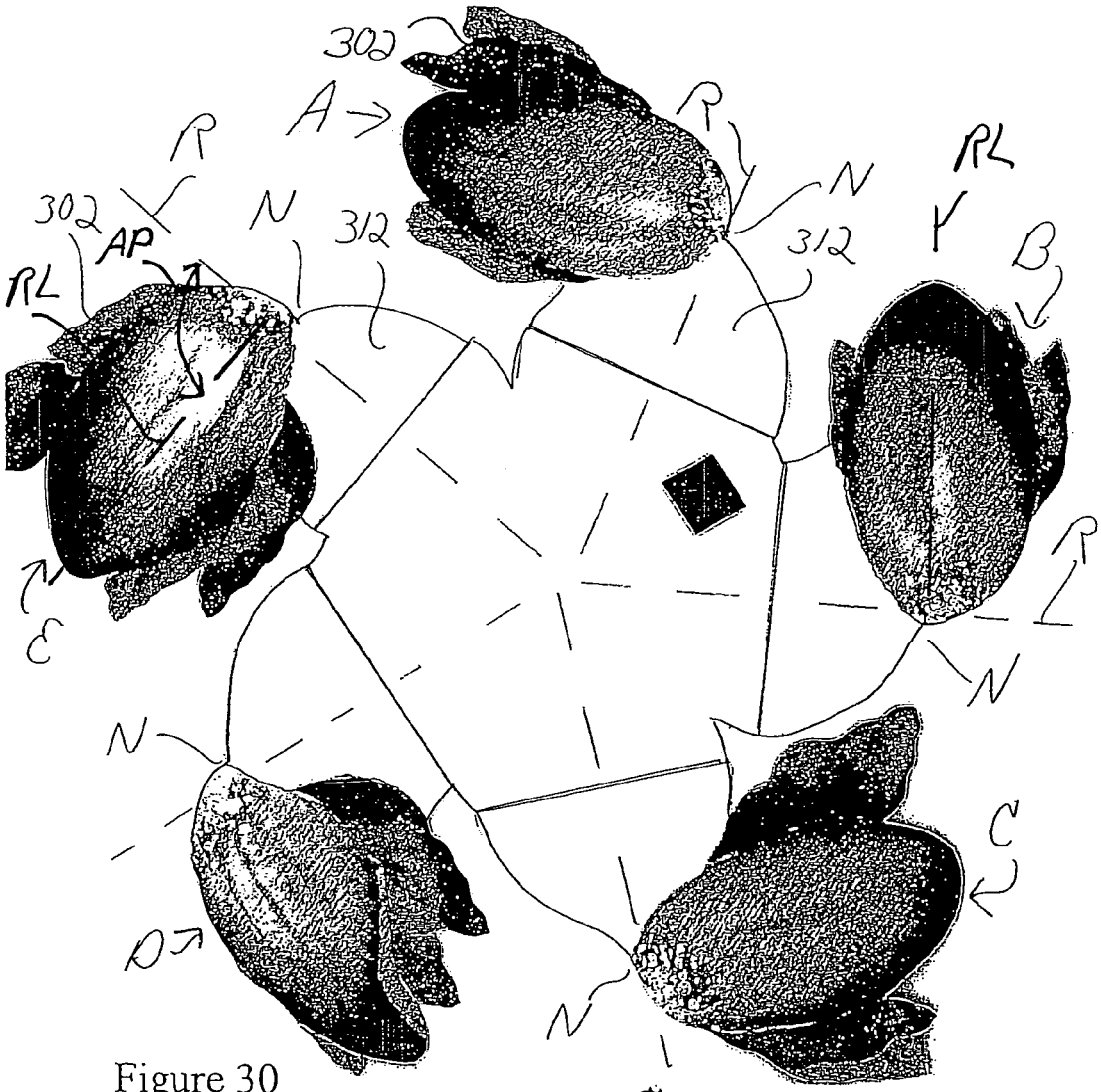
FIGS. 30 and 31 are an unfolded rear view, and a folded front view, respectively, of an embodiment forming an alternative flower image.
Figure 31:
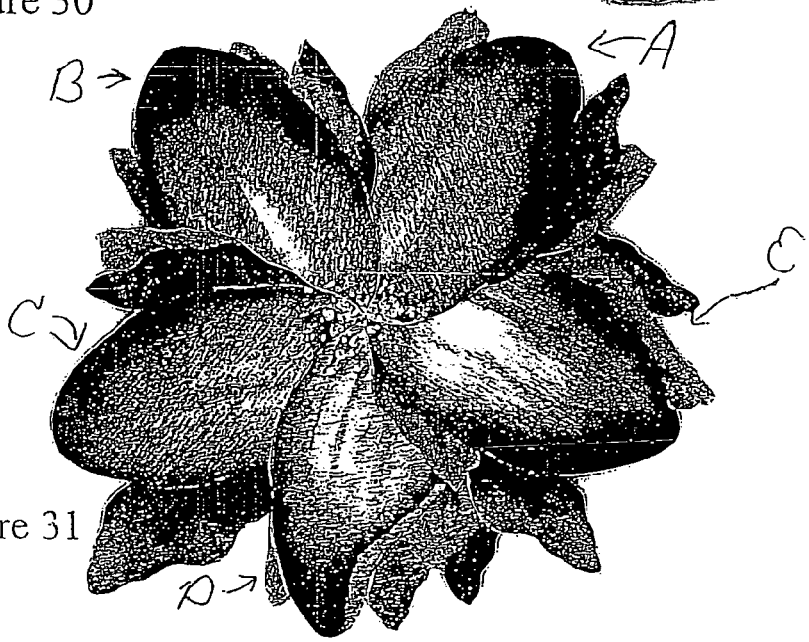

FIGS. 30 and 31 illustrate a flower embodiment, in which only the visible portions 304 are decorated and the connecting portions 312 are not. One may see that the visible portions 302 are pivoted approximately 90 degrees (angle AP) from the radial dimension R of the panels.

Figure 32:
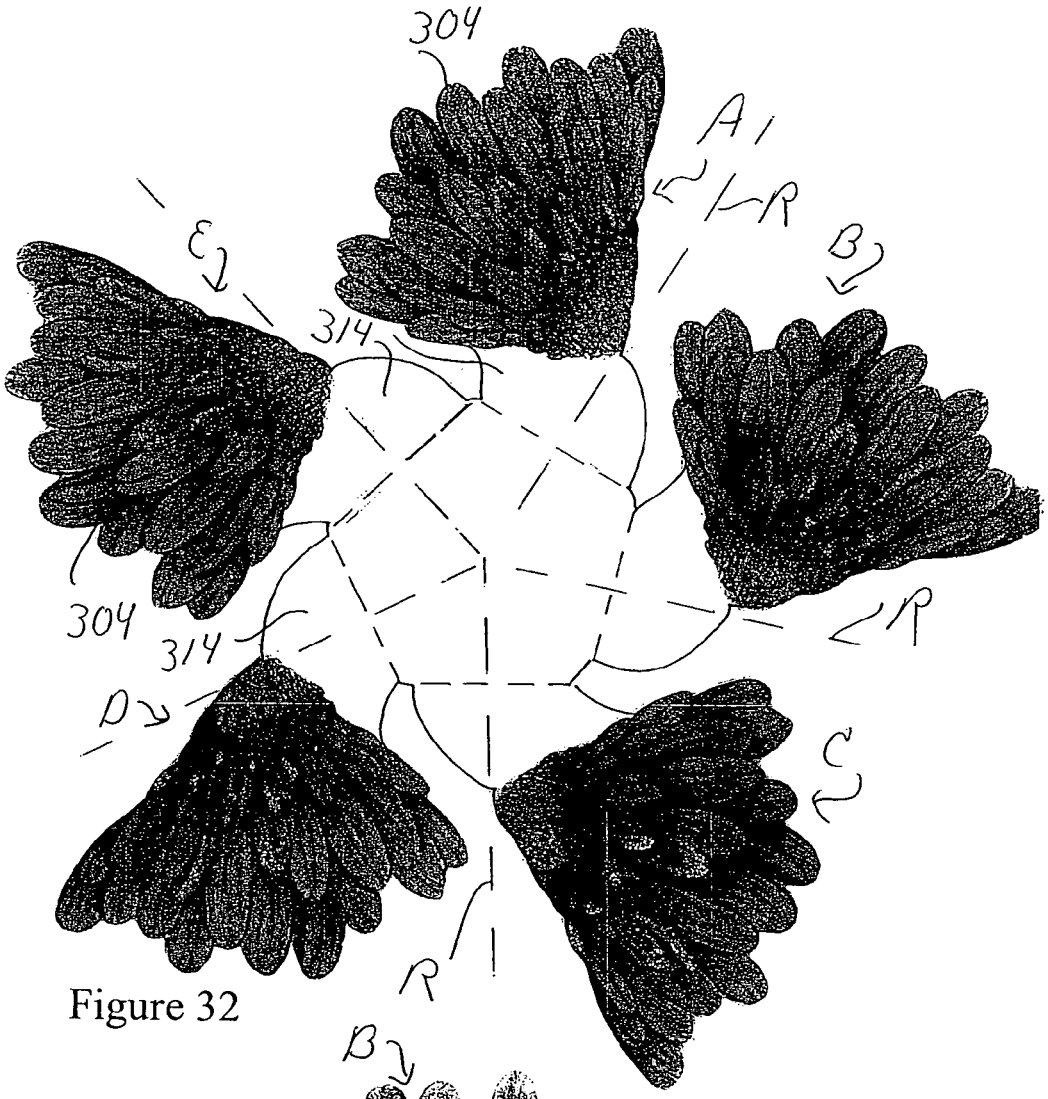
FIGS. 32 and 33 are an unfolded rear view, and a folded front view, respectively, of an embodiment forming another flower image.
Figure 33:
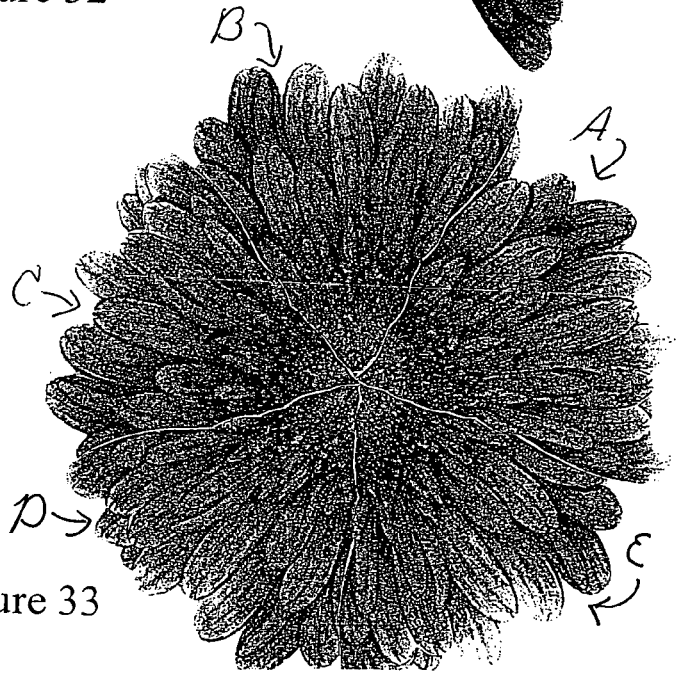

FIGS. 32 and 33 illustrate another flower embodiment in which only the visible portions 304 are decorated and the connecting portions 314 are not. One may see that the visible portions 304 are pivoted approximately (Angle AP) degrees from the radial dimension R of the panels.

Figures 34, 35:
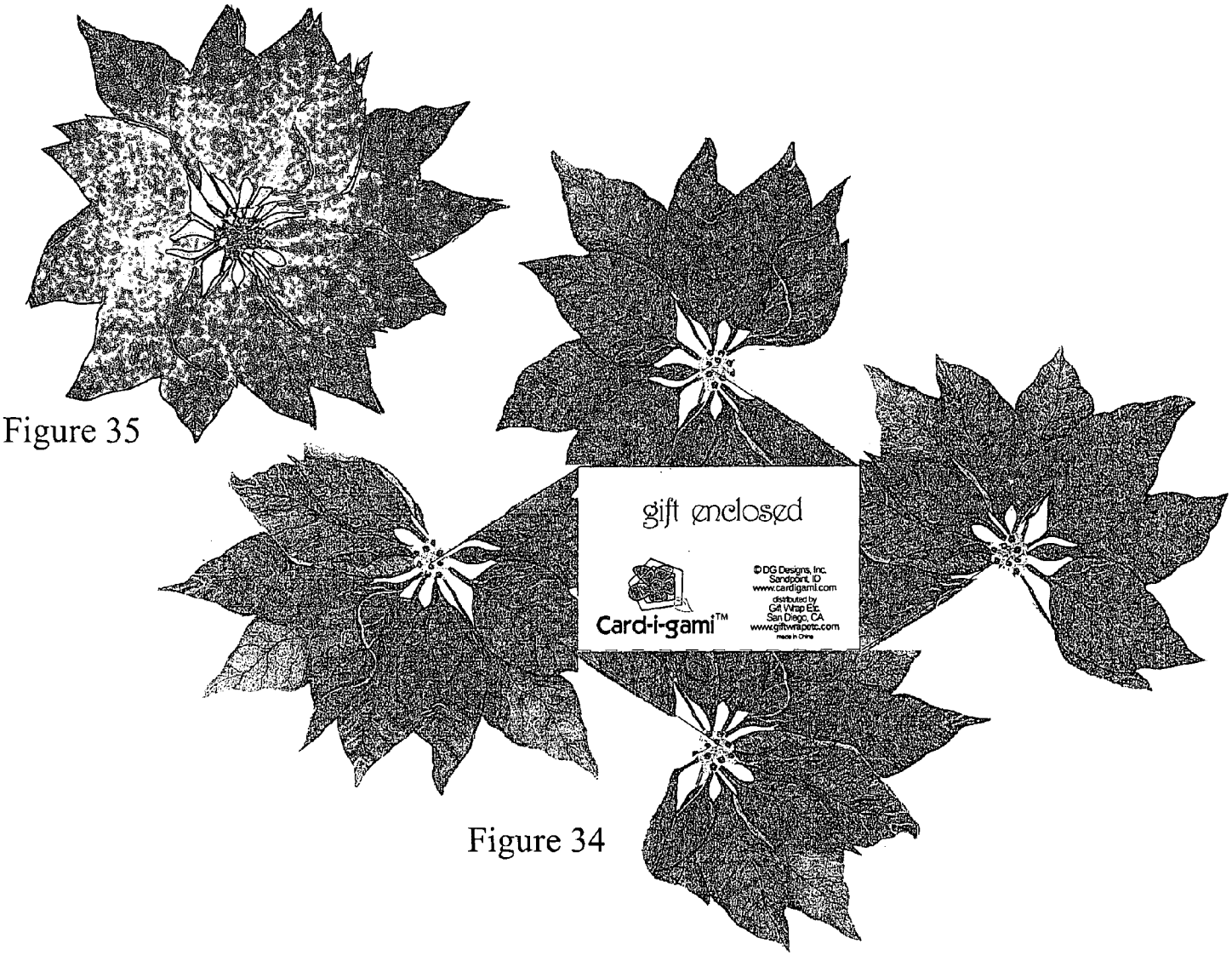
FIGS. 34 and 35 are an unfolded rear view, and a folded front view, respectively, of an embodiment forming a poinsettia image.

FIGS. 34 and 35 illustrate a poinsettia card, wherein the entirety of each panel is decorated, but, as discussed above, the connecting portion of each panels and its decoration is hidden when the card is folded. In this poinsettia card having a rectangular central region, a unified picture of a poinsettia is divided into fourths, and each ¼ image (plus "extra" image on each side) is placed on each panel at an angle to the straight radial line. In this embodiment, especially because the connecting portions are also decorated, each panel displays about 250-260 degrees of the picture, but only approximately 90 degree visible portions (¼ of the picture) are actually visible on each panel when the card is folded. However, some of the underlying tips of the poinsettia leaves, from connecting portions, may be visible behind the visible portions, hence, contributing to an interesting and artistic appearance.

Figure 37:
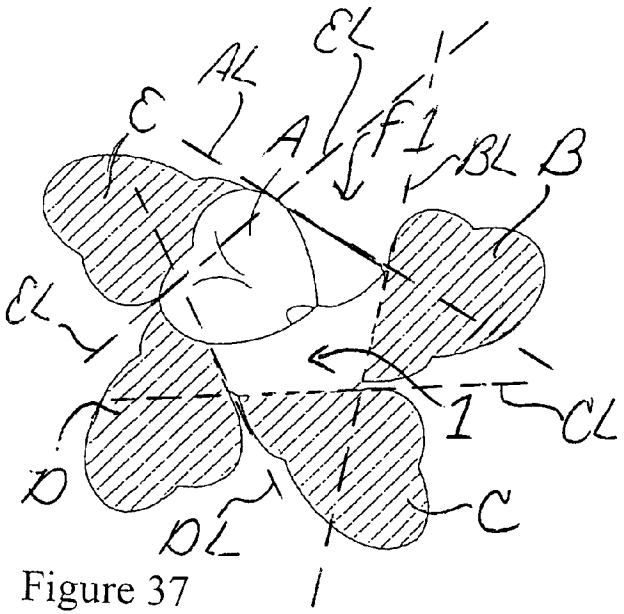
FIGS. 36-38 are front views of the embodiment in FIGS. 1-3, illustrating the lines/planes across which the panels of the embodiment do and do not extend when unfolded and folded.
Figure 36:
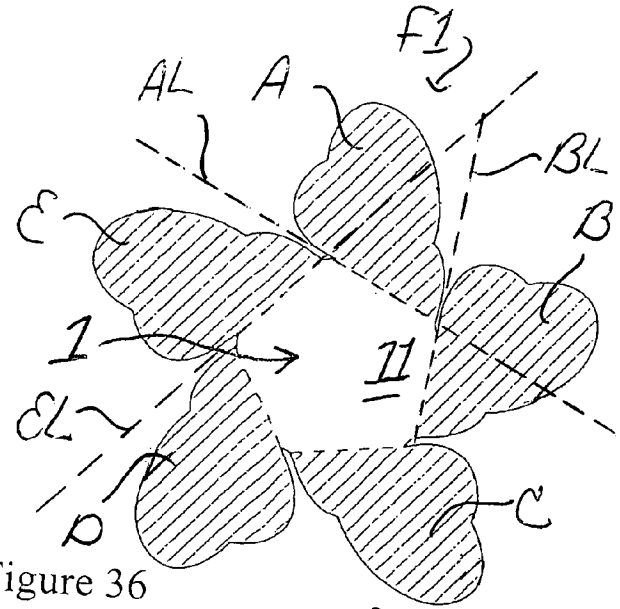
Figure 38:
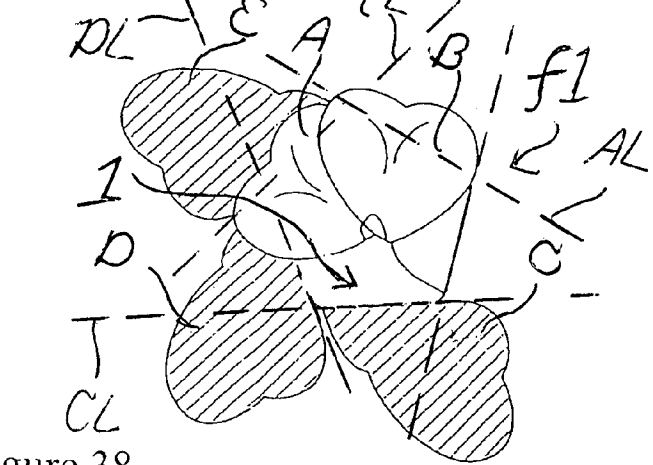

Therefore, one may see from the Figures that, when the panels are folded, the panels extend toward the center of the central region and curve or turn away from said center to extend across the foldline of the adjacent panel or the two next adjacent panels. Thus, each of said panels extends beyond the central region by crossing over a first and preferably also a second foldline plane, wherein said first and second foldline planes are perpendicular to the central region plane and pass, respectively, through the single fold of an immediately adjacent panel and through the single fold of a panel that is two panels away. For example, as shown in FIGS. 35-37, panel A folds on line AL, panel B folds on line BL, etc. When the card is folded, each panel extends across the foldline of one adjacent panel and, preferably, across two of the adjacent panel foldlines. For example, as shown in FIGS. 35 and 36, panel A does not extend across AL (AL defining the fold or hinge of panel A) or across BL when unfolded, but panel A does extend across EL. When folded, panel A extends across EL and DL, but still not AL and not BL. In other words, it may be said that there are planes perpendicular to the sheet that extend through each of said foldlines, and that panel A does not cross through the plane of BL either when unfolded or folded, but that panel A does cross through the plane of EL and the plane of DL when folded. Likewise, panel B does not cross through the plane of BL or the plane of CL when unfolded or when folded, but does cross through the plane of AL and the plane of EL when folded. Thus, one may say that each panel extending from each fold line does not cross a first imaginary line (or perpendicular plane) extending through a first adjacent fold line (on a first side of the panel) when unfolded or folded, but does cross a second imaginary line (or plane) through a second adjacent fold line (on the opposite side of the panel) when unfolded and when folded. In a card such as the embodiment in FIGS. 36-38, therefore, it may be said that each panel extending from each fold line does not cross a first imaginary line (or perpendicular plane) extending through a first adjacent fold line (adjacent in the clockwise direction) when unfolded or folded, but does cross a second imaginary line (or plane) through a second adjacent fold line (adjacent in the counterclockwise direction) when unfolded and when folded. Further, panels in such an embodiment as FIGS. 36-38 may be said to cross the third imaginary line (or perpendicular plane) through a third fold line (two panels couterclockwise) when folded.

Especially-Preferred Methods

The inventor has determined that a mathematical/geometric system may be applied to methods of making the preferred cards. This system of making embodiments of the invented card-like apparatus may be particularly beneficial for computer-based graphics programs, wherein a digital picture, drawing, or other image is dissected into sectors by the software (and/or by instruction from the user of the software), and the sectors are placed, again by computer software (and/or by instruction from the user of the software), onto a template/outline of a card that is later cut out, or even onto a pre-cut card. A more detailed discussion follows.

Figure 39:
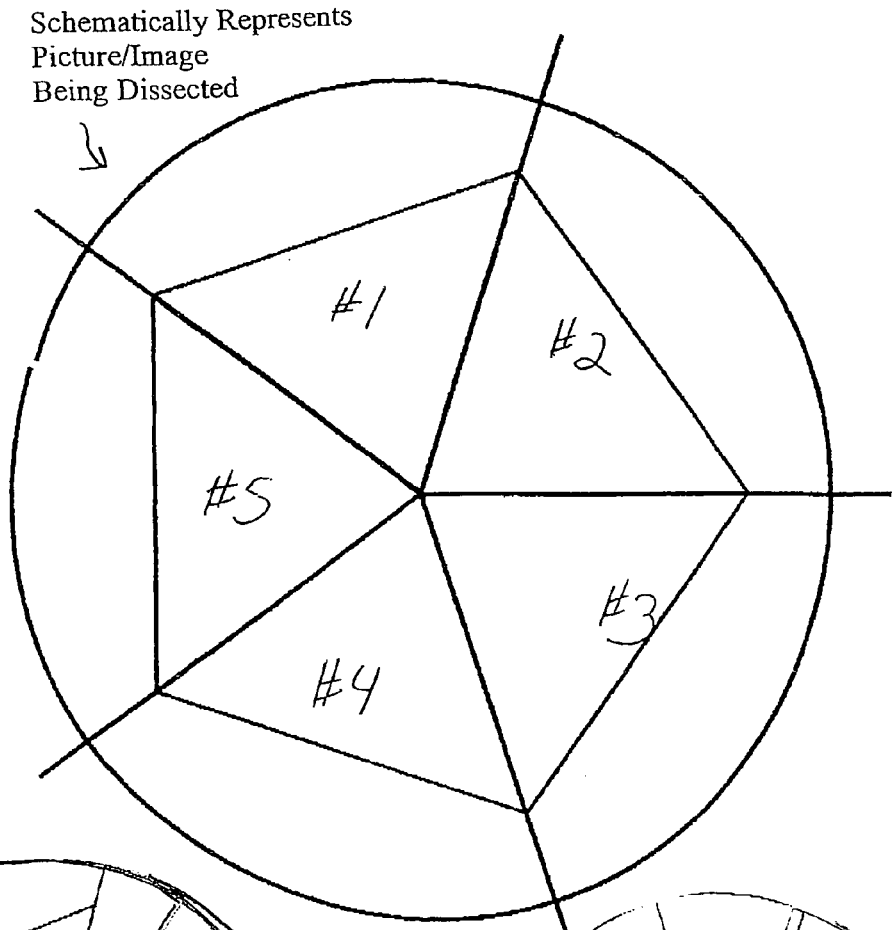

A complete or "unified" picture is cut into fractions. For example, the circle in FIG. 39 generally represents a complete, unified picture that is cut into fifths along the radial lines in FIG. 39, to obtain five sectors (each bounded by two radii and the arc between the radii). In FIG. 39, each sector is numbered, and a triangular portion of the sector is also "mapped out" by the lines extending between the radii to form a pentagon shape.

Figure 40A:
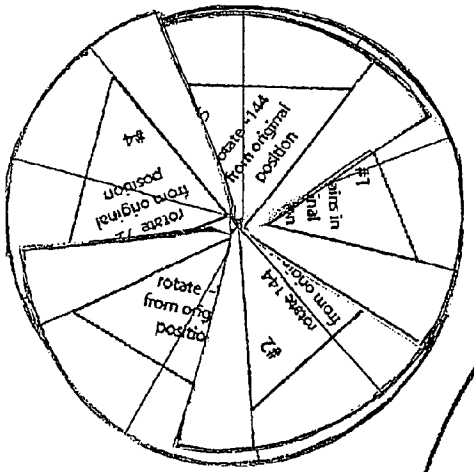
Figure 40B:
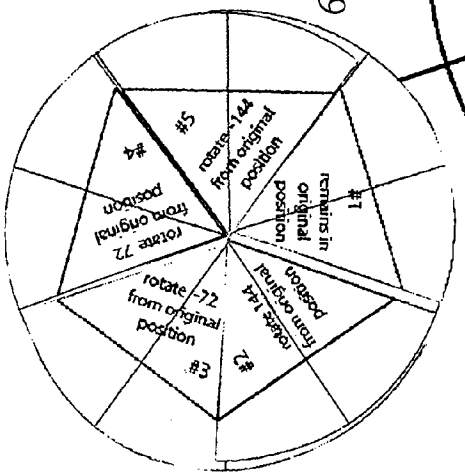
Figure 40:
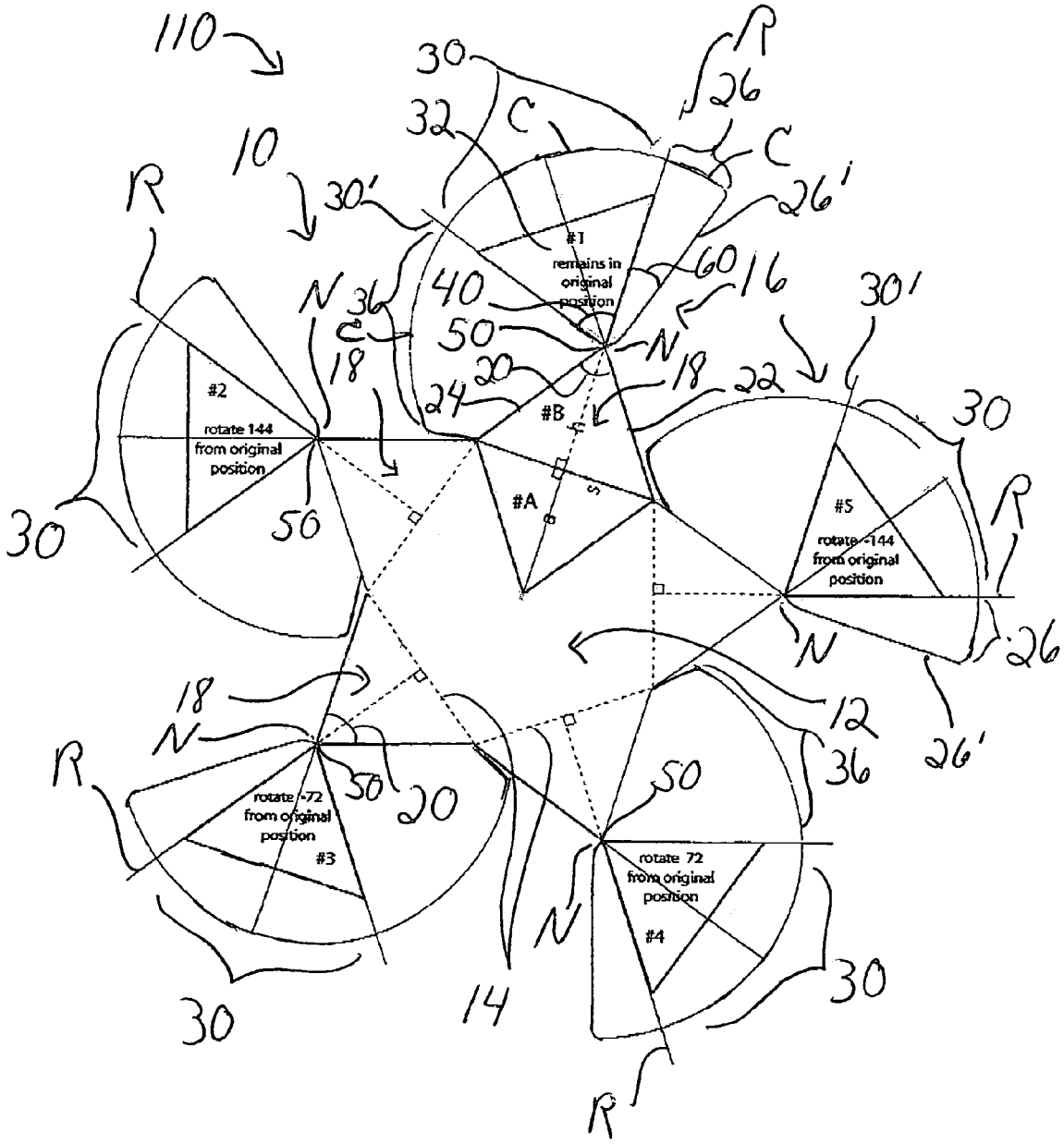

As illustrated in FIG. 40, each of the sectors (that is, each ⅕ of the picture) is placed on one of the panels in a pentagon-based, five-panel card, so that the picture sectors become the visible portions of the panels. If some overlap of the visible portions is desired, slightly more than ⅕ of the picture is placed on the visible portion, that is, the ⅕ sector plus a little more of the picture from one side or both sides of the sector. In other words, ⅕ of the picture is required to create a whole picture when the card is folded, but the "little bit extra" on each side gives each panel some overlap over the other panels when the card is folded, and, in doing so, as discussed below, the "little bit extra" or overlap will affect what portions of the decorated panel are actually visible.

Figure 26:
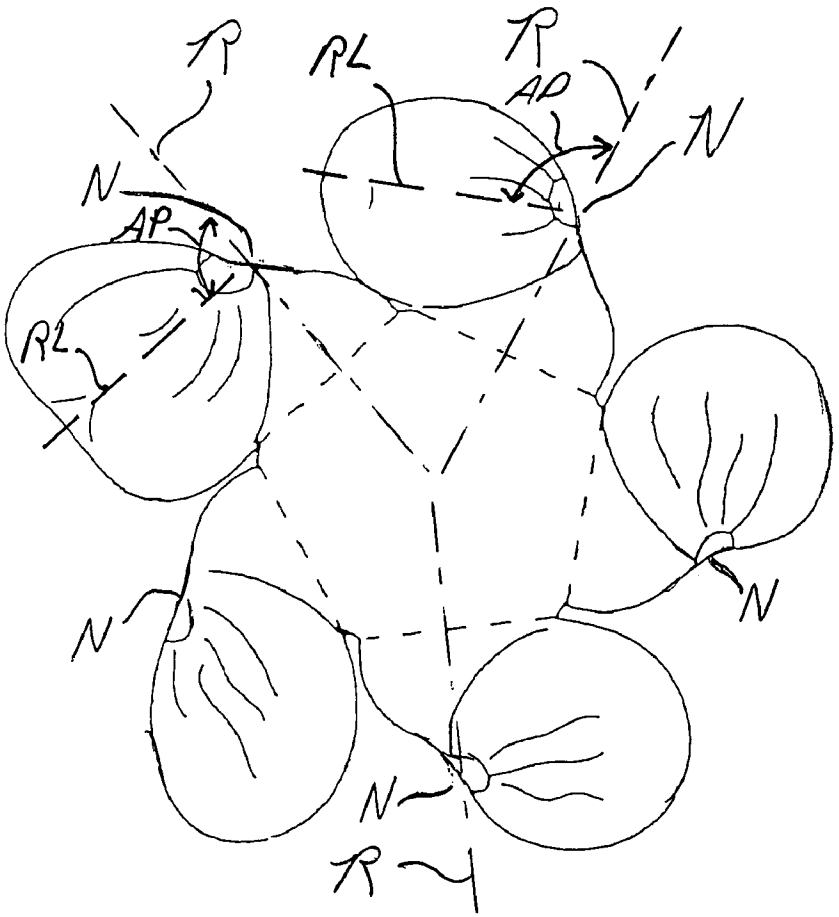
FIG. 26 is a front view of the unfolded sheet of FIG. 7, except that the notch area has been made less deep to purposely create a point of contact for the panels that does not allow the panels to lie completely flat.
Figure 27B:
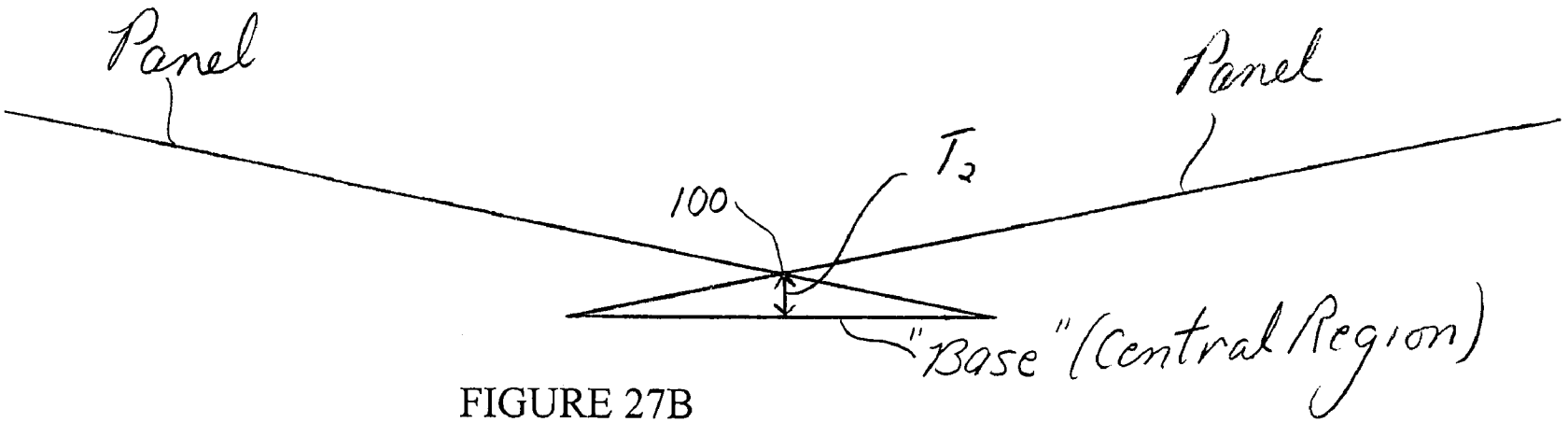
FIG. 27B is a schematic edge view, illustrating that in the slightly-three-dimensional card, such as might be made from the sheet in FIG. 26, the panels are slightly elevated relative to the central region and the thickness (T2) is greater than in FIG. 27A.

When placed on the panels, each sector at an angle, preferably 32-40 degrees and most preferably 36 degrees, relative to the straight radial line extending from the center of the central region (noted as "R" in FIGS. 26, 30, 32). Also, one may determine the position of the sector placed on the sheet (in FIG. 40) relative to its original placement in the picture (FIG. 39). For example, sector 1 in FIG. 39 is not moved when placed in FIG. 40; it is at approximately an 11 o'clock position in both Figures. Sector 2, however, is rotated counterclockwise 144 degrees from its orientation in FIG. 39 to its orientation in FIG. 40. Sector 3 starts out as the approximately 4 o'clock position in FIG. 39 and is rotated clockwise 72 degrees to its orientation in FIG. 40. Sector 4 is rotated counterclockwise 72 degrees to its orientation in FIG. 40. Sector 5 is rotated 144 degrees clockwise to its orientation in FIG. 40. In other words, sector 1 doesn't change its orientation relative to vertical on the pages of FIGS. 39 and 40 (from top to bottom on the pages), but sector 2 and sector 5 switch orientations, and sector 3 and 4 switch orientations relative to vertical on the pages of FIGS. 39 and 40. Note that rotation clockwise is called "negative" in FIG. 40 and rotation counter-clockwise is called "positive" in FIG. 40. Then, when the card is folded, the connecting portions are hidden, and, in general, the decorated portions (sectors cut from the complete picture) are positioned properly to again form the unified picture, reproduced on the folded card; when folded, the decorated portions again extend radially out from the center of the card (typically from the contact point of the panels), as they did in the uncut, un-dissected picture, to form a proper image of a flower on the card.

Examples of Mathematical/Geometric System for Manufacture of the Apparatus

Referring specifically to FIG. 40, a folding card 10 having five panels 16 is schematically illustrated to show how the sectors from FIG. 39 are positioned. FIG. 40 shows the folding card 10 when it is laid open and flat. The folding card 10 should be made of a flat sheet-like material capable of being folded, preferably paper or cardboard. However, other materials that are capable of being folded, such as plastic or thin metal, could also be used. The folding card 10 used in this method will have an interior central region 12 which is a regular polygon, meaning that it is a polygon in which all sides have equal lengths and all angles have equal measures. These sides will be referred to as central segments 14. The folding card 10 will eventually be folded along these central segments 14. In the embodiment shown in FIG. 40, the interior central region 12 has five sides, forming a pentagon.

Panels 16 extend from each of the central segments 14. The folding card preferably consists entirely of the interior central region 12 and the panels 16 extending from each of the central segments. The goal is to configure the panels 16 in such a manner that when the folding card 10 is folded along the central segments 14, all of the panels 16 are capable of lying flat across the central interior region 12, and will extend across at least one central segment 14 which is not the central segment 14 from which the panel 16 extends. In the folded position, each of the panels 16 will overlap one adjacent panel (to one side of the given panel) and be overlapped by one adjacent panel (to the other side of the given panel). The process of folding the panels 16 one at a time to get to this position is shown in FIGS. 47A-F, which is a snowman embodiment. Designs will preferably be printed or otherwise created on the bottom side of the panels 16 so that the folding card 10 shows a coherent design in its folded position, as shown in FIGS. 47A-F.

The difficulty in configuring the panels 16 is that if the panels 16 contain material in places where the panels 16 should not contain material, that is, have too shallow or no notch N, as discussed above, then the panels 16 will interfere with each other during the folding process, preventing all of the panels 16 from lying flat along the interior central region 12; if the panels 16 do not contain material where the panels 16 should contain material, then there may be gaps in the overlap of the panels 16 over the interior central region 12, reducing the aesthetic quality of the folding card 10.

Rather than configure and decorate the panels 16 by "trial and error," the inventor has developed the following preferred geometric process for configuring the panels 16. Each panel 16 begins with a first isosceles triangle 18, having a base (first side) which is the central segment 14 from which the panel 16 extends, a second side 22 and a third side 24 of equal length, and an angle 20 opposite from the base which has a measurement of three-hundred sixty degrees divided by the number of panels 16; in the preferred embodiment with five panels 16 a pentagon for the interior central region 12, the angle 20 will have a measurement of seventy-two degrees.

An optional, first panel portion 26 may be described as bound on one side by the radial line R bisecting the first isosceles triangle 18 and on the other side by an edge 26'. The first panel portion 26 is typically optional, as it, when the card is folded, provides overlap with an adjacent panel on one side of a given decorated sector of the picture. This first panel portion preferably represents less than a 40 degree portion (angle 60), and preferably approximately a 20 degree portion. A portion greater than this might interfere with the card laying flat, especially is sufficient room/space were not given in the notch N, as discussed above.

A second panel portion 30 of the panel, including isosceles triangle-shaped portion 32, has an angle 40 which has the same measurement as the angle 20 of the first isosceles triangle 18, and is bounded on one side by radial line R and on the other side by line 30'. Preferably, the first panel portion 26 and the second panel portion 30 each have a length (from the notch N to the outer edge C) that is greater than the height of the first isosceles triangle 18 (from angle 20 to the center of the base/segment 14), or in other words, the first panel portion 26 and the second panel portion 30 will each extend away from the first isosceles triangle 18 a distance which is greater than the height of the triangle 18. The reason for this length of the first panel portion 26 and the second panel portion is so that when the panels are folded along the central segments 14, each panel 16 will extend across the central region 12 and beyond the perimeter of the central region 12, to cross through a plane (perpendicular to the paper in FIG. 39) that extends through at least one central segment 14 other than the central segment 14 from which that particular panel 16 extends. As discussed earlier in the Description, this allows the distal ends of the panels to extend preferably far beyond the perimeter of the central region when the card is folded.

An optional, third panel portion 36 is bounded by line/edge 30' on one side and side 24 of the isosceles triangle 18 on the other side. Third panel portion 36 extends out from the point of contact 50 (between the first isosceles triangle 18 and the second isosceles triangle 32) preferably a length generally similar to the length of the first and second panel portions 26, 30, that is, preferably a length greater than the height of the isosceles triangle 18. The lengths (radial lengths in this discussion) of the portions 26, 30, and 36 may be different from each other and may be irregular (resulting in an irregular outer edge C) in order to follow the outline of the image being used on the card. Again, as discussed earlier in the Description, this length allows the distal ends of the panels to extend preferably far beyond the perimeter of the central region when the card is folded.

It is important to note that the sectors cut from the "picture" in FIG. 39 are placed on the second panel portion 30, and that the "extra" picture taken from either side of the sector of the picture in FIG. 39, is placed either on first panel portion 26 or third panel portion 36, depending on from which side of the sector the "extra" picture is taken. Both first panel portion 26 and third panel portion 36 are optional, as noted above, as these provide overlap of the panels, which is desirable but not absolutely necessary to completely cover the central region when the card is folded (because the second panel portions 30 themselves total to be 360 degrees of picture). Note that, even if third panel portion 36 extends nearly all the way to the adjacent panel, it should not be connected to the adjacent panel, because this would prevent either panel 16 from freely folding over the interior central region 12.

It also should be noted that, if "extra" image is "lifted" from the picture in FIG. 39 and placed on the optional panels 26, that each panel 26 will overlap panel portion 30 of the underlying adjacent panel, hence covering up some of the image on that panel portion 30 (See FIG. 40A). If the panels are cut/formed to be the same shape (that is, all the panels on the card having optional panel 26), then, when the card is folded, the visible portion on any one of the given panels will be the 72 degrees of image on that panel starting at its edge 26' and extending to the edge 26' of the overlaying panel. In such a scenario, the optional panel 36 of each panel will be covered up by the overlaying panel. Thus, optional panels 36 are typically not visible when the card is folded, except if the image and panel in that portion is made to have a length (from point 50 to the outer perimeter of the image C) so that it extends radially out from underneath the overlaying panel. Applying image to the optional panels 36, however, can give the card an interesting layered appearance when folded, and an interesting attractive appearance when unfolded (see, for example, the poinsettia embodiment in FIGS. 34 and 35, wherein image placed on the entire panel (that is, portion 30, plus on optional portions 26 and 36) makes the unfolded card impressive and attractive and also creates a very layered look that is similar to the many leaves/petals of a real poinsettia. The overlapping caused by including optional portions 26 is illustrated in FIG. 40A, which is the card of FIG. 40 cut out and folded along the fold lines surrounding the pentagonal central region 12. If the optional portions 26 were not used in the card of FIG. 40, the folded result would appear as in FIG. 40B.

When the preferred five-sided embodiment of the folding card 10 is folded along the central segments 14 so that the panels 16 overlay the interior central region 12, the point of contact 50 of each panel 16 will lay above the center of the interior central region 12 and the base of the second isosceles triangle 32 will lay above a central segment 14 two sides away from the central segment 14 from which the panel 16 extends. The entire second isosceles triangle 32 will overlay the interior central region 12.

Figure 41:
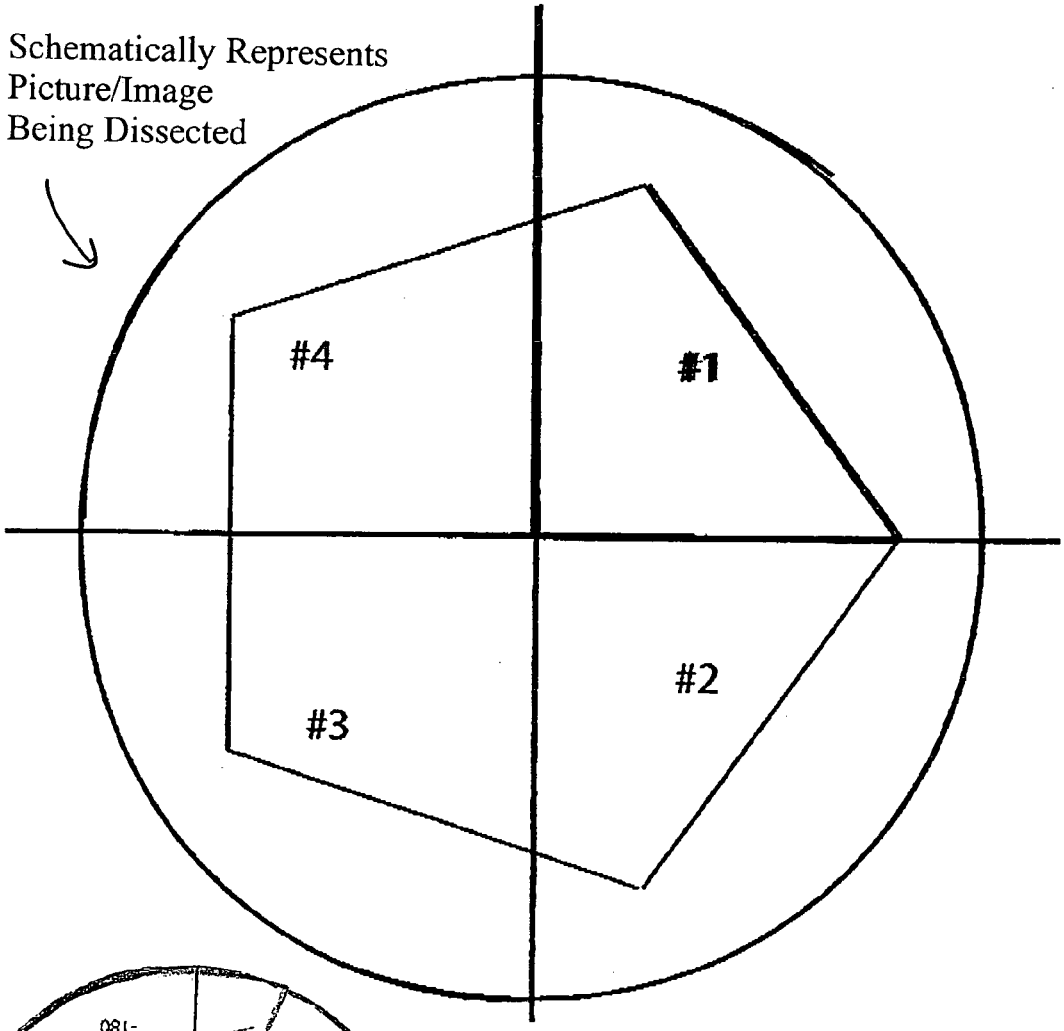
Figure 42A:
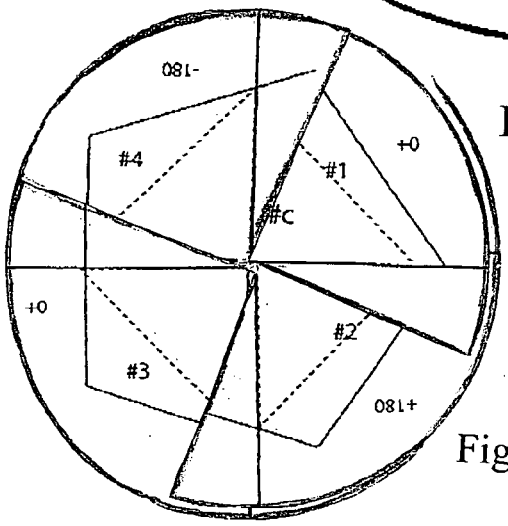
Figure 42:
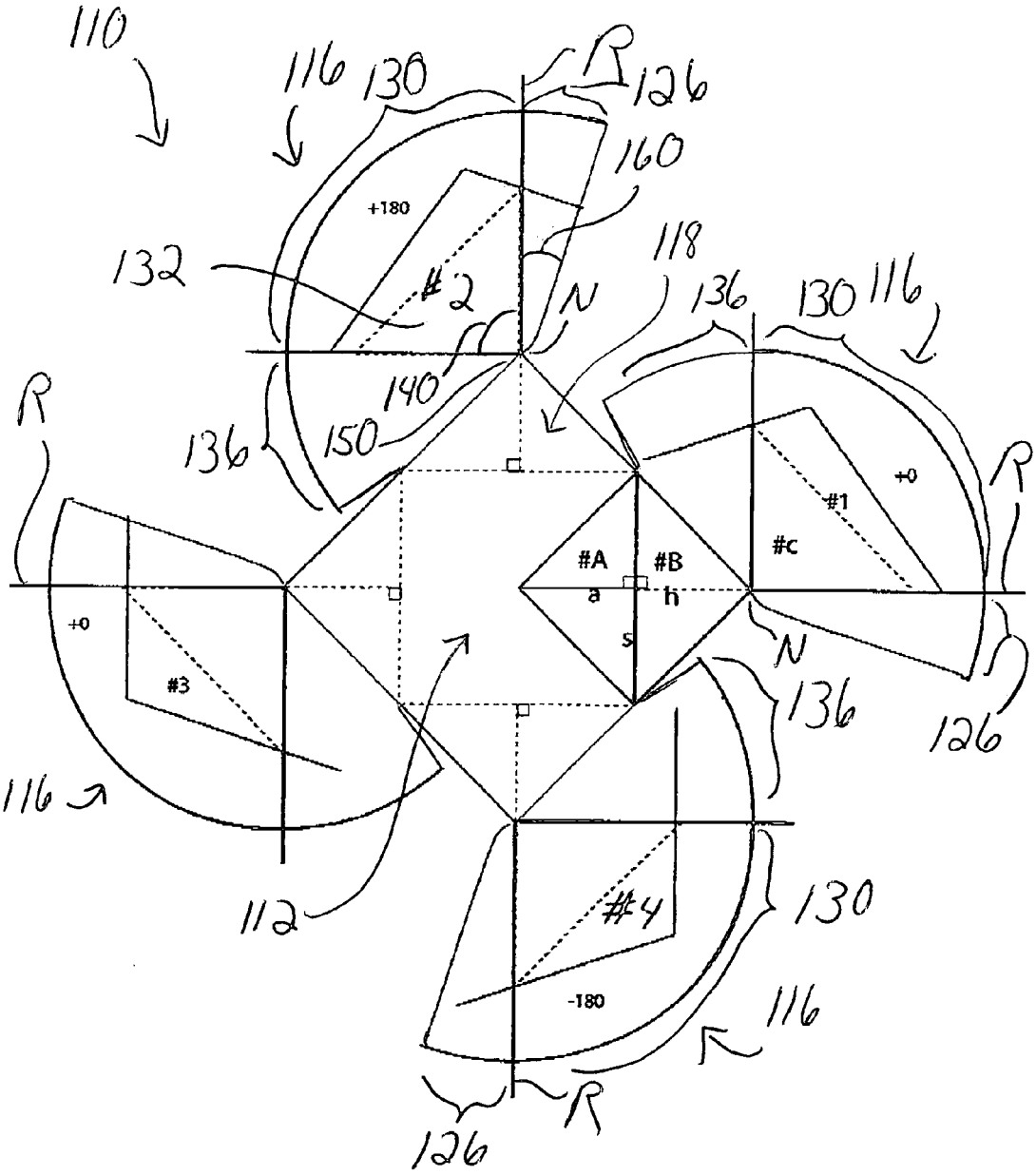

The four-sided embodiment shown in FIGS. 41, 42, and 42A operates in a similar manner to the schematics and methods of FIGS. 39, 40, and 40A. In this embodiment, the interior central region 112 is a square, the first isosceles triangle 118 and second isosceles triangle 132 are right isosceles triangles, and the general relationships between said triangles and the three panel segments 126, 130, 136 when the folding card 110 is flat and unfolded are similar to the five-sided embodiment. The point of contact 150 between the first isosceles triangle 118 and the second isosceles triangle 132 of each panel 116 will again overlie the center of the interior central region 112 when the folding card 110 is folded. It should be noted that, when the embodiment illustrated in FIG. 42 is folded, the triangles 138 will not only overlay the central region 112, but will also extend beyond the perimeter of the central region 112.

The image sectors (each ¼ of the picture in FIG. 41) plus optional "extra" image on either side of the sector may be lifted/copied from the unified picture of FIG. 41 and placed on the panels in FIG. 42. One may see from FIG. 42, that sector 1 is not rotated relative to its position on FIG. 41, sector 2 is rotated 180 degrees, sector 3 is not rotated relative to its position on FIG. 41, and sector 4 is rotated 180 degrees.

Again, if no optional panel 126 is used (and therefore no extra image is lifted on that side of the given sector), angle 160 will be zero, and portion 130 will be completely visible when the folding card 110 is folded. If optional panel 126 is used (and therefore "extra" image is lifted on that side of the given sector), angle 160 will not be zero, and portion 126 will overlay part of portion 130 of the underlying panel. See FIG. 42A.

Figure 43:
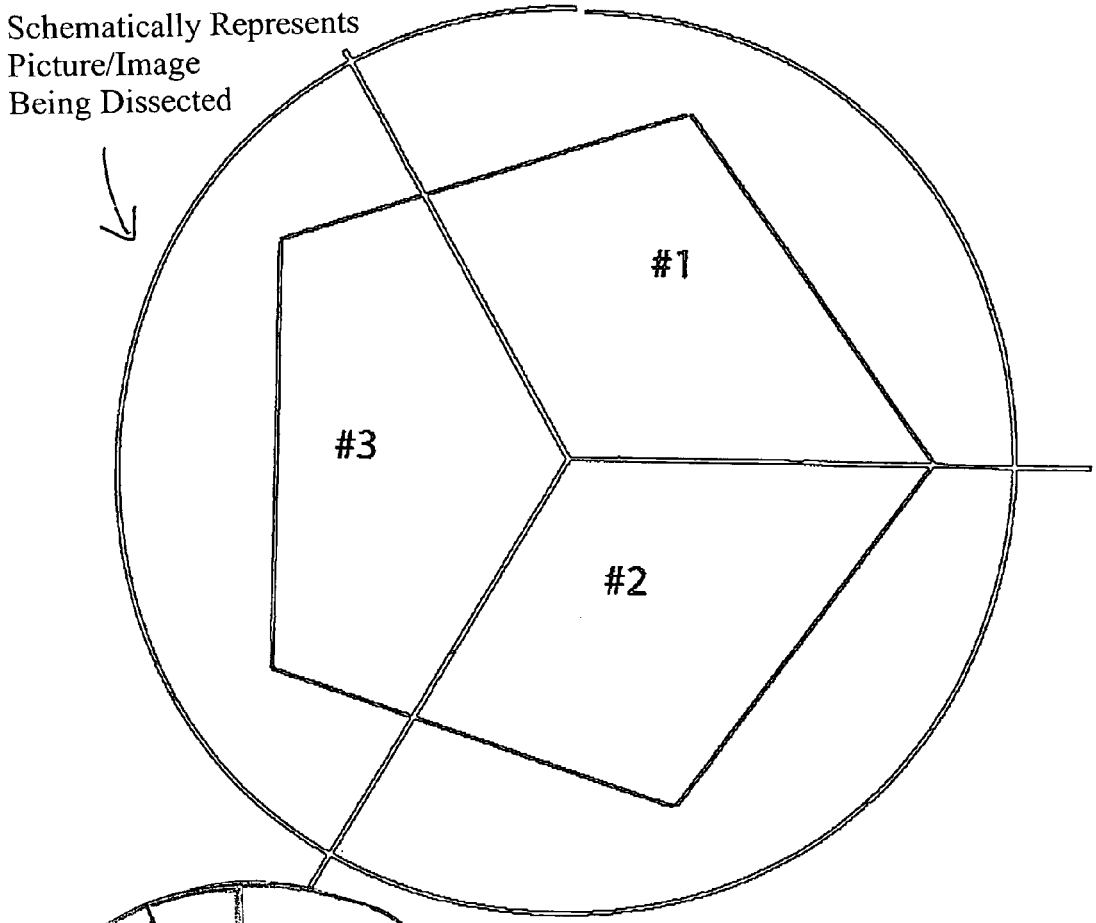
Figure 44A:
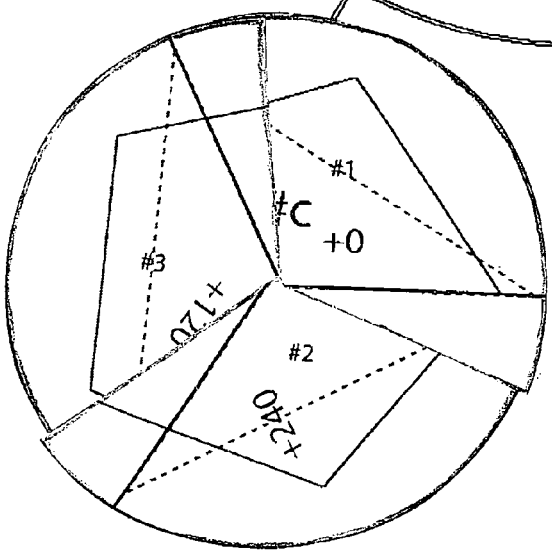
Figure 44:
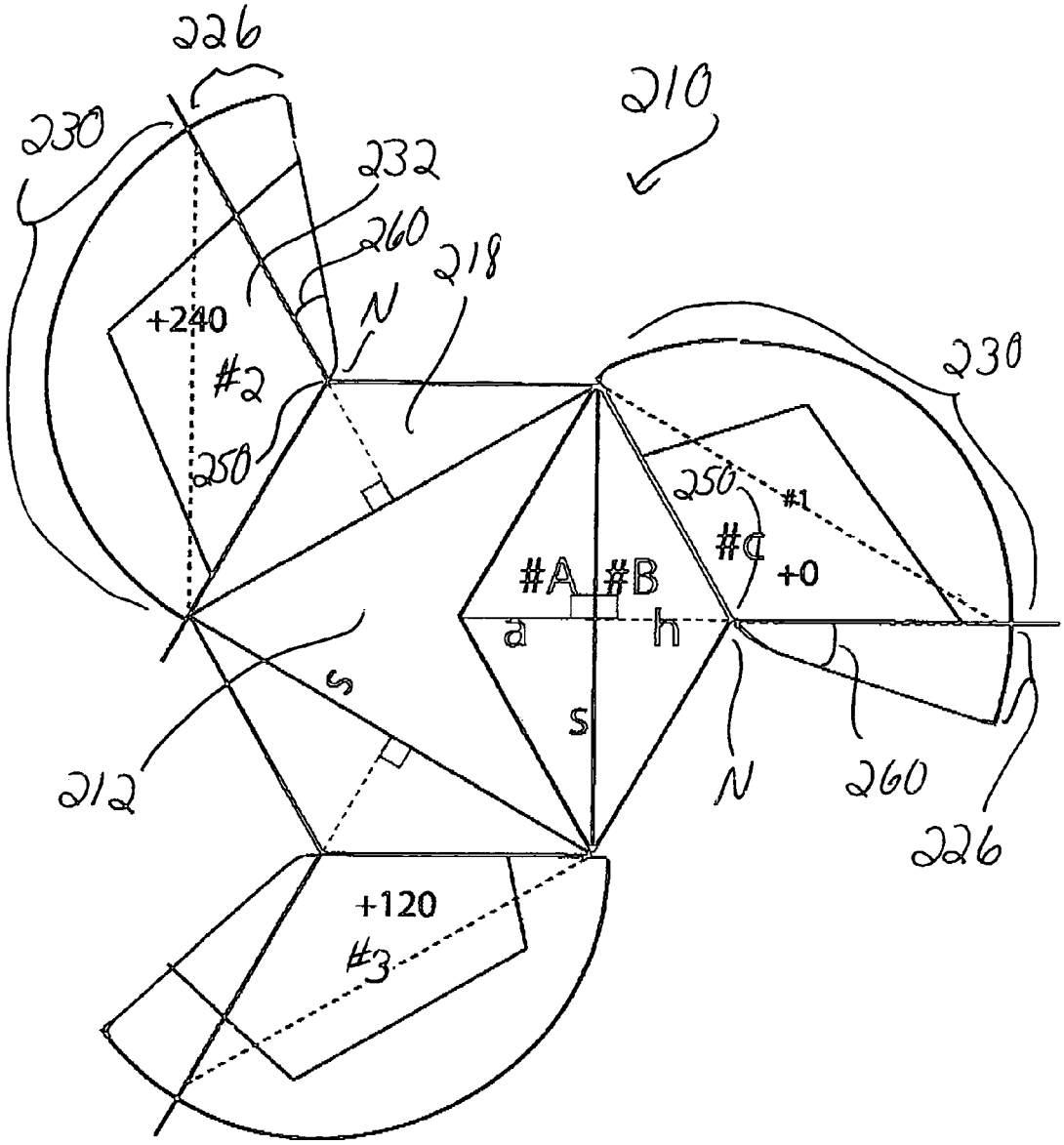

The three-sided embodiment shown in FIGS. 43, 44, and 44A operates in a manner similar to the four-sided embodiment and the five-sided embodiment. In the three-sided embodiment, the interior central region 212 is an equilateral triangle, the first isosceles triangle 218 and second isosceles triangle 232 are isosceles triangles with angles of one-hundred twenty degrees, thirty degrees, and thirty degrees, and the relationships between said triangles and the three panel segments 226, 230, when the folding card 210 is flat and unfolded are similar to the four- and five-sided embodiments. Again, when the folding card 210 is folded, if optional panel 226 is used (and "extra" image lifted/coped to cover it), then angle 260 is not zero, and panels 226 will overlap part of the underlying portions 230 of the adjacent panels. If optional panels 226 are not used (and no "extra" image is lifted/copied), then angle 260 is zero, and portions 230 will be fully visible when the card is folded. The point of contact 250 will overlie the center of the interior central region 212. The second isosceles triangle 232 will overlay the central region.

FIGS. 45, 46, and 47A-F illustrate the principles of the above-discussed schematics. A whole snowman picture (only partly drawn in FIG. 45 so that the image will not cover up the sector lines for the reader of this Description) is dissected into five sectors, numbered #1 through #5. Each sector's image is lifted or copied (preferably by computer software) with "extra" image on both sides of the respective sector for overlap. According to the rotations described for FIG. 40, the sectors are laid/copied onto the panels in FIG. 46. One will note that "extra" image is used, and, hence, optional panel portions 26 and 36 are also used on each panel.

Figure 46:
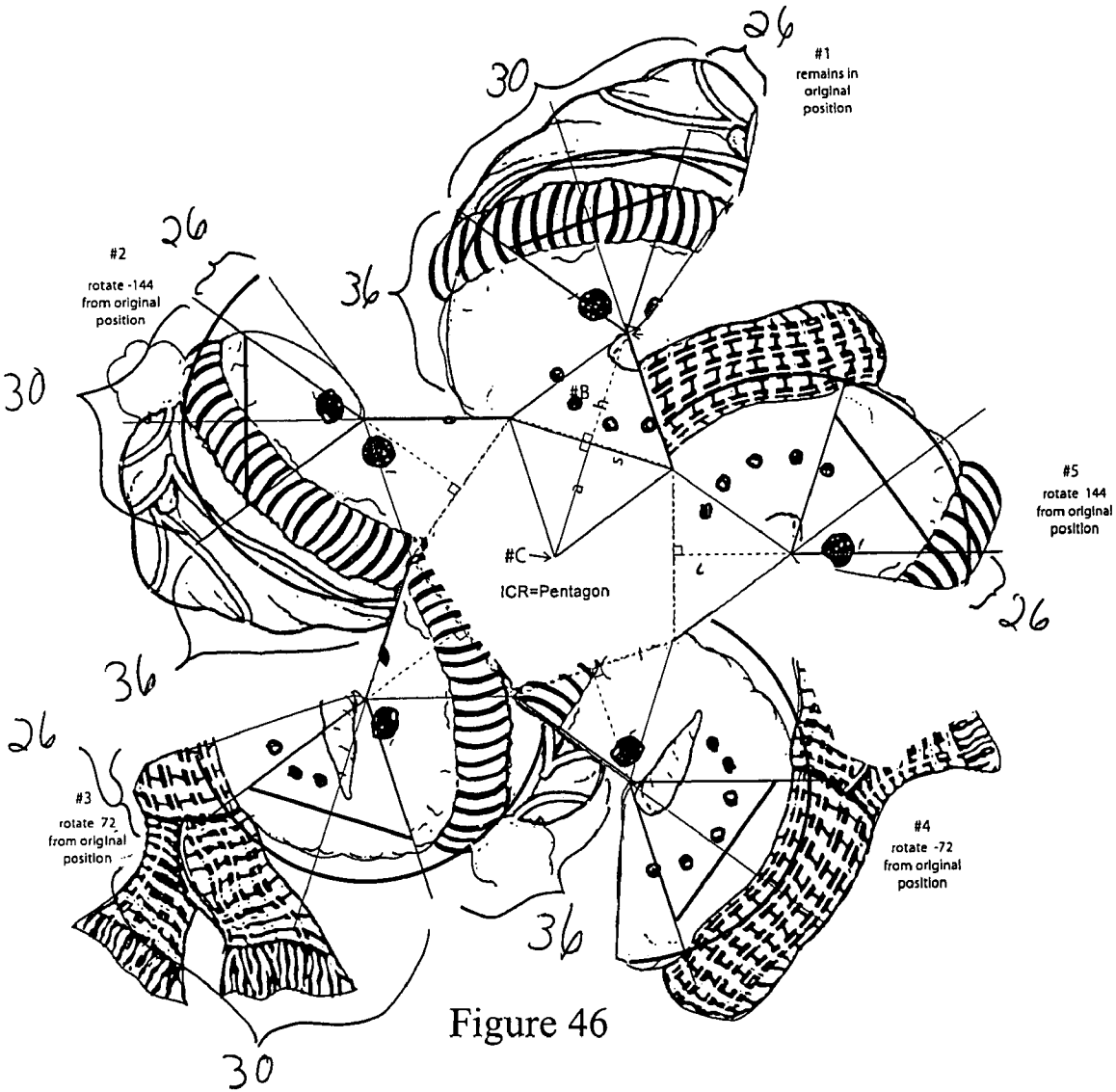
Figure 45:
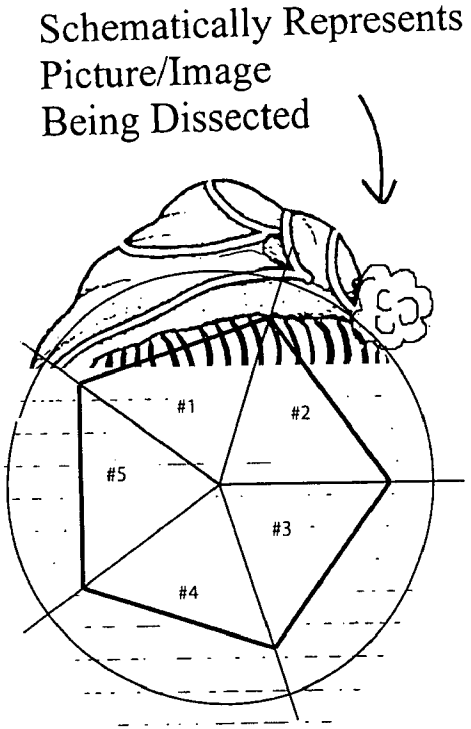
Figure 47A:
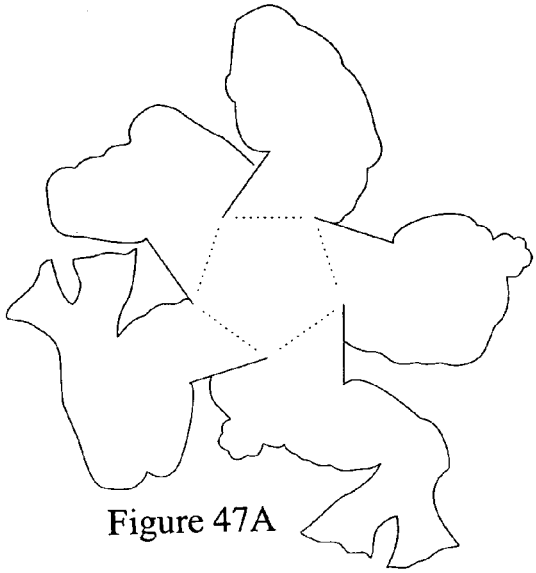
FIGS. 47A-F show sequential folding of the card sheet to create the folded card, which again represents the whole snowman picture.
Figure 47B:
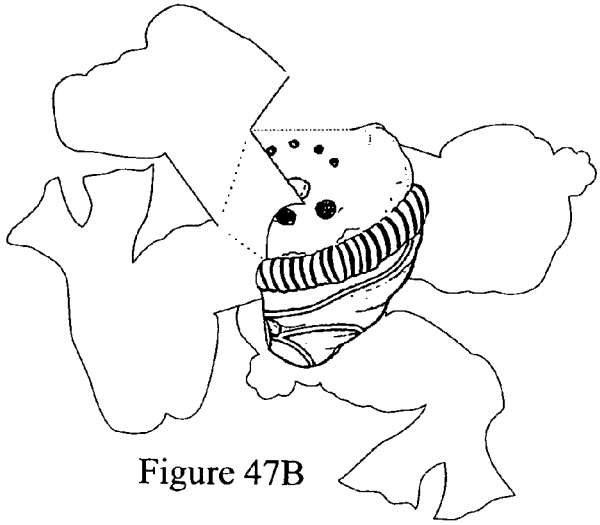
Figure 47C:
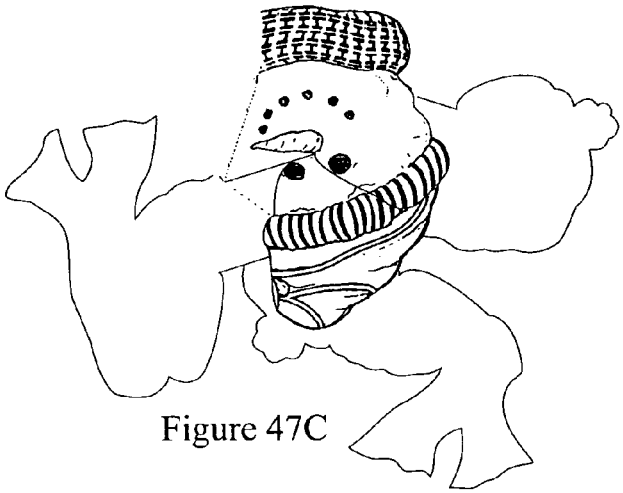
Figure 47D:
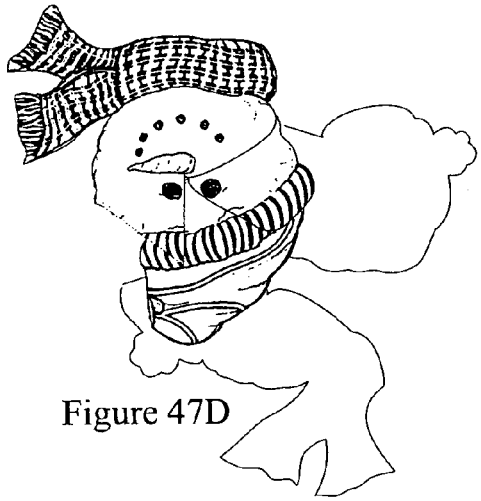
Figure 47E:
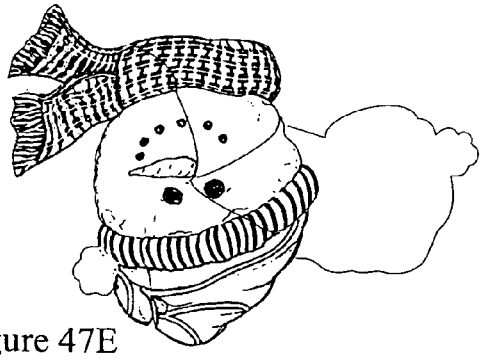
Figure 47F:
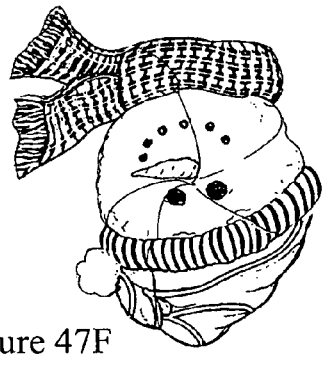

FIGS. 47A through F illustrate one-panel-at-a time folding, starting with the panel shown at the top of the FIG. 46 page. FIG. 47A is the card of FIG. 46 turned over to show the undecorated surface. FIGS. 47B-F show the first through fifth panels being folded, resulting in the completely folded card of FIG. 47F. Because the card orientation during folding in FIG. 47A-F has been chosen to correspond to the card orientation in FIG. 46, the snowman, as it is folded, is "upside down," but one may easily see how the folding progresses and the finished, folded card is simply rotated for viewing.

Preferred Simplicity of the Folded Forms

Many of the preferred embodiments may be described as being made from a single sheet and with a single fold between the central region or "base" and each panel. Thus, the preferred embodiments are not integral with a box or other three-dimensional container. A conventional box will have a bottom, multiple vertical walls extending upwards from a first set of folds between the vertical walls and the bottom, and another set of folds between the vertical walls and a top of the box. Further, a conventional box will have a significant internal space created by the presence of the vertical walls, said internal space being substantial and capable of containing an object of some size.

The preferred embodiments of the invented card apparatus, therefore, are very different from a box in that they preferably have no vertical walls and very little, if any, internal space. While the paper/sheet in many embodiments of the present invention may fold by bending between generally parallel planes, the preferred bend should not be considered to include a vertical wall because the preferred bend is a sharp or tight bend.

It may be said that the preferred embodiments consist of only a single sheet cut into a central region and a plurality of panels, wherein only a single fold is between each panel and the central region, and wherein each panel is substantially parallel to the plane of the central region. Also, it may be said of many embodiments that the panels, together, cover the central region, so that the central region is not visible in a top/plan view (top view of the apparatus as it sits on a surface, also called "front view" in places in this Description, because the viewer is seeing the "front" of the card). Some embodiments may feature panels that are said to substantially cover the central region, wherein "substantially"in this context is greater than 90 percent.

Further, it may be said of many embodiments, that each of the panels extends away from its fold line a distance greater than a greatest length/dimension across the interior central region. Preferably, the panels extend a significant distance beyond the perimeter of the central region, preferably at least a distance equal to ⅓, and more preferably at least ½, of the diameter or average dimension across the central region. In many embodiments, this extension beyond the perimeter of the central region is present all the way around the central region, and by at least portions of all the panels. Thus, in many of the preferred embodiments, the outermost extremity of the apparatus (when in a view such as in FIGS. 6, 8, 10, 14, 16, 18, 29, 31, 33, 35, and 47F) are the outer edges of the panels and not any part of the central region. Thus, in many embodiments, the panels and the image created by the panels is the majority of the structure of the apparatus and, visually, the only significant structure.

The preferred panels each have an irregular outer perimeter (preferably non-straight, and also preferably not curved on a single radius) and the preferred outer perimeter of the apparatus is also irregular (preferably non-straight, and also preferably not curved on a single radius), which makes for an interesting representation that is unlike a regular geometric shape. The preferred embodiments have a thickness T1 or T2 that is much less than their dimensions generally parallel to the panels.

Although this invention has been described above with reference to particular means, materials and embodiments, it is to be understood that the invention is not limited to these disclosed particulars, but extends instead to all equivalents within the scope of the following claims.

I claimed:

1. A folded card comprising a sheet, wherein the sheet has a central region with a perimeter and a plurality of panels each extending from a portion of the perimeter, the panels being folded over the central region and meeting at a contact area over the central region, and said panels extending from the contact area past another portion of the perimeter to extend beyond the central region, so that substantially all of the central region is covered by the panels;

wherein only a single fold is between said central region and each of said panels; and wherein the folded panels have distal edges that are irregular.

2. A folded card as in claim 1, wherein at least some of the folded panels have distal edges that together represent an item selected from the group consisting of an object, an animal, a plant, a flower, a person, and a caricature of an animal or person.

3. A folded card as in claim 1, wherein at least some of the folded panels have decoration on outer visible surfaces that together represent an item selected from the group consisting of an object, an animal, a plant, a flower, a person, and a caricature of an animal or person.

4. A folded card as in claim 1, wherein the card has no vertical walls between the central region and the panels.

5. A folded card comprising a sheet, wherein the sheet has a central region with a perimeter and a plurality of panels each extending from a portion of the perimeter, the panels being folded over the central region and meeting at a contact area over the central region, and said panels extending from the contact area past another portion of the perimeter to extend beyond the central region, so that substantially all of the central region is covered by the panels;

wherein only a single fold is between said central region and each of said panels; and wherein the folded panels have distal edges that are non-straight and also not curved on a single radius.

6. A folded card as in claim 5, wherein at least some of the folded panels have distal edges that together represent an item selected from the group consisting of an object, an animal, a plant, a flower, a person, and a caricature of an animal or person.

7. A folded card as in claim 5 wherein at least some of the folded panels have decoration on outer visible surfaces that together represent an item selected from the group consisting of an object, an animal, a plant, a flower, a person, and a caricature of an animal or person.

8. A folded card as in claim 5, wherein the card has no vertical walls between the central region and the panels.

9. A folded card comprising a sheet, wherein the sheet has a central region with a perimeter and a plurality of panels each extending from a portion of the perimeter, the panels being folded over the central region and meeting at a contact area over the central region, and said panels extending from the contact area past another portion of the perimeter to extend beyond the central region, so that substantially all of the central region is covered by the panels;

wherein only a single fold is between said central region and each of said panels; and wherein the folded panels extend beyond the central region, all around the central region, a distance equal to at least ⅓ of the average dimension across the central region and passing through a center of the central region.

10. A folded card comprising a sheet, wherein the sheet has a central region with a perimeter and a plurality of panels each extending from a portion of the perimeter, the panels being folded over the central region and meeting at a contact area over the central region, and said panels extending from the contact area past another portion of the perimeter to extend beyond the central region, so that substantially all of the central region is covered by the panels;

wherein only a single fold is between said central region and each of said panels; and wherein the central region is a pentagon.

11. A folded card comprising a sheet, wherein the sheet has a central region with a perimeter and a plurality of panels each extending from a portion of the perimeter, the panels being folded over the central region and meeting at a contact area over the central region, and said panels extending from the contact area past another portion of the perimeter to extend beyond the central region. so that substantially all of the central region is covered by the panels;

wherein only a single fold is between said central region and each of said panels; and wherein the panels each have a radial dimension and a decoration portion that is visible when the panels are folded, and each of said decoration portions has a radial length and is positioned on its respective panel so that radial length is at an angle in the range of 30 degrees to 150 degrees from the radial dimension of the panel.

12. A folded card as in claim 11 wherein:

said central region lies on a central region plane;

each of said panels extends beyond the central region by crossing over a first and a second foldline plane, wherein said first and second foidline planes are perpendicular to the central region plane and pass, respectively, through the single fold of an immediately adjacent panel and through the single fold of a panel that is two panels away.

13. A folding card comprising:

an interior central region in the shape of a regular polygon defined by fold lines and lying on a central region plane;

a plurality of panels;

a single fold line between each of the panels and the interior central region;

wherein each panel has a radial dimension and has a distal portion extending at an angle to the radial dimension, so that, when the folding card is folded along each of the fold lines between said panels and the interior central region, each distal portion:

crosses a first foldline plane and a second foidline plane, said first foldline plane passing through a first one of said single fold lines immediately adjacent to the panel and being perpendicular to said central region plane, and said second foldline plane passing through a second one of said single fold lines two panels away; and each distal portion does not cross a third foldline plane, said third foldline plane passing through a third one of said single fold lines that is immediately adjacent on a side of the panel opposite to said first one of said single fold lines and being perpendicular to said central region plane.

14. The folding card of claim 13 wherein the interior central region is in the shape of a pentagon and the plurality of panels consist of five panels.

15. The folding card of claim 14 wherein the five panels are shaped to completely cover the interior central region when the folding card is folded along each of the fold lines between said panels and the interior central region.

16. The folding card of claim 15 wherein the five panels are shaped so that the folding card is flat when the folding card is folded along each of said single fold lines between said panels and the interior central region.

17. The folding card of claim 14 wherein the five panels are shaped so that each of the panels lays across approximately one-fifth of the interior central region.

18. A folding card as in claim 13, wherein the panels each have a radial dimension and a decoration portion that is visible when the panels are folded, and each of said decoration portions has a radial length and is positioned on its respective panel so that radial length is at an angle in the range of 30 degrees to 110 degrees from a radial dimension of the panel.

19. The folding card of claim 13 wherein the folding card consists only of said interior central region and the plurality of panels.

20. A folding card comprising:

an interior central region in the shape of a regular polygon defined by fold lines;

a panel extending from each of the fold lines;

wherein the plurality of panels are shaped so that the panels will cover up the entire interior central region and each of the plurality of panels will extend across and beyond the interior central region when the folding card is folded along said fold lines; and wherein each of the panels extends away from its respective fold line a distance greater than a greatest dimension across the interior central region;

wherein the panels comprise ornamental designs that form a single image when the sheet is folded.

21. The folding card of claim 20 wherein the regular polygon is a pentagon.

22. The folding card of claim 20 wherein the manufacture is flat when the manufacture is folded along the fold lines from which the panels extend.

* * * * *